US009302878B2

(12) United States Patent
Ono

(10) Patent No.: US 9,302,878 B2
(45) Date of Patent: Apr. 5, 2016

(54) IMAGE FORMING APPARATUS

(71) Applicant: KYOCERA Document Solutions Inc., Osaka-shi, Osaka (JP)

(72) Inventor: Tomohisa Ono, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/693,789

(22) Filed: Apr. 22, 2015

(65) Prior Publication Data

US 2015/0307311 A1 Oct. 29, 2015

(30) Foreign Application Priority Data

Apr. 23, 2014 (JP) ..... 2014-089275

(51) Int. Cl.
*B65H 43/06* (2006.01)
*B65H 31/02* (2006.01)

(52) U.S. Cl.
CPC ..... *B65H 43/06* (2013.01); *B65H 31/02* (2013.01); *B65H 2301/4212* (2013.01); *B65H 2402/45* (2013.01); *B65H 2405/1117* (2013.01); *B65H 2553/41* (2013.01); *B65H 2553/612* (2013.01); *B65H 2601/321* (2013.01); *B65H 2801/06* (2013.01)

(58) Field of Classification Search
CPC ..... B65H 43/06; B65H 43/08; B65H 31/02; B65H 2553/41; B65H 2511/152; B65H 2553/412; B65H 2553/612
USPC ..... 271/176
See application file for complete search history.

(56) References Cited

U.S. PATENT DOCUMENTS 6,292,636 B1 * 9/2001 Kwon ..... B41J 11/0075 271/10.03
2005/0035535 A1 * 2/2005 Ogata ..... B65H 43/02 271/220
2005/0184448 A1 * 8/2005 Aoyagi ..... B65H 31/10 271/110
2011/0233851 A1 9/2011 Sugishima
2012/0112402 A1 * 5/2012 Onishi ..... G03G 15/6552 271/109

FOREIGN PATENT DOCUMENTS

JP 2010064851 A 3/2010
JP 2011201681 A 10/2011

* cited by examiner

*Primary Examiner* — David H Bollinger
(74) *Attorney, Agent, or Firm* — Alleman Hall McCoy Russell & Tuttle LLP

(57) ABSTRACT

The present disclosure relates to image forming apparatus capable of preventing damage even when actuator for detecting sheets loaded on sheet tray is rotated beyond acceptable range. A rotation shaft is disposed in the vicinity of a cover rotation portion of a sheet tray that is to be opened and closed. The image forming apparatus includes a connection portion and an actuator rotating in accordance with an amount of loaded sheets. The actuator includes a rotation shaft, a first rotor supported on the rotation shaft, and a second rotor that is rotatably supported by a cylindrical portion coaxial to the rotation shaft. The connection portion is configured to, when the first rotor rotates in a direction away from the sheet placement surface, make contact with, and rotate the second rotor in the same rotation direction, and rotate only the first rotor when the second rotor reaches a predetermined position.

8 Claims, 11 Drawing Sheets

IMAGE FORMING APPARATUS

INCORPORATION BY REFERENCE

This application is based upon and claims the benefit of priority from the corresponding Japanese Patent Application No. 2014-089275 filed on Apr. 23, 2014, the entire contents of which are incorporated herein by reference.

BACKGROUND

The present disclosure relates to an image forming apparatus having a sheet tray attached so as to be openable and closeable with respect to an upper surface of a main body of the apparatus.

An image forming apparatus capable of continuously color-printing onto multiple sheets is known. On the image forming apparatus, various instruments for image formation such as a photoconductor, a developing device, and the like are installed inside the box-form main body of the apparatus. Furthermore, the image forming apparatus includes a sheet tray that also serves as an upper cover for closing an upper surface opening of the main body of the apparatus. The sheet tray is supported rotatably about a support shaft extending in one direction, and is formed so as to be capable of changing positions between a closed position and an open position with respect to the upper surface opening of the main body of the apparatus. The support shaft is disposed in the vicinity of a discharge portion where sheets are discharged from the main body of the apparatus. In addition, in the vicinity of the support shaft, a detection mechanism for detecting a fully loaded state at which the number of sheets discharged from the discharge portion and loaded on the sheet tray has reached a preset upper limit for the number of sheets is disposed. For example, conventionally, a detection mechanism of detecting whether or not the sheets loaded on the sheet tray are in the fully loaded state by rotating an actuator in accordance with the number of sheets loaded on the sheet tray is known.

SUMMARY

An image forming apparatus according to one aspect of the present disclosure includes a sheet discharge outlet, a sheet tray, an actuator, and a detection portion. The actuator includes a first rotation shaft, a base end portion, a connection portion, a contactor, and a detected member. A sheet is discharged from the sheet discharge outlet. The sheet tray is rotatable, using its side toward the sheet discharge outlet as a rotation fulcrum, between an open position configured to open an inside of a housing and a closed position configured to close the inside of the housing and enable loading of discharged sheets on the sheet tray. The actuator rotates in accordance with the load amount of sheets on the sheet tray. The detection portion is configured to detect that a rotation position of the actuator has reached a detection position. The first rotation shaft is disposed above the sheet discharge outlet. The base end portion is connected to the first rotation shaft and is rotatable about the first rotation shaft. The connection portion is configured to connect the first rotation shaft and the base end portion in an integrally rotatable manner in a predetermined rotation direction. The contactor extends from the first rotation shaft toward the sheet tray, is integrally rotatable with the first rotation shaft, and rotates in accordance with the load amount of sheets loaded on the sheet tray. The detected member extends in a direction perpendicular to the first rotation shaft, is rotatable in response to rotation of the base end portion, is detected at the detection position by the detection portion, and is rotatable to a stop position beyond the detection position. The connection portion is configured to form a connection between, and integrally rotate, in the predetermined rotation direction, the first rotation shaft and the base end portion until the detected member reaches the stop position, and release the connection formed by the connection portion when the detected member reaches the stop position, and rotate, in the predetermined rotation direction, only the first rotation shaft in a state where the detected member is being stopped at the stop position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, a first embodiment and a second embodiment of the present disclosure will be described with reference to the drawings as appropriate. It should be noted that the embodiments described below are merely specific examples of the present disclosure, and do not limit the technical scope of the present disclosure.

First Embodiment

[Image Forming Apparatus 10]

Figure 1:
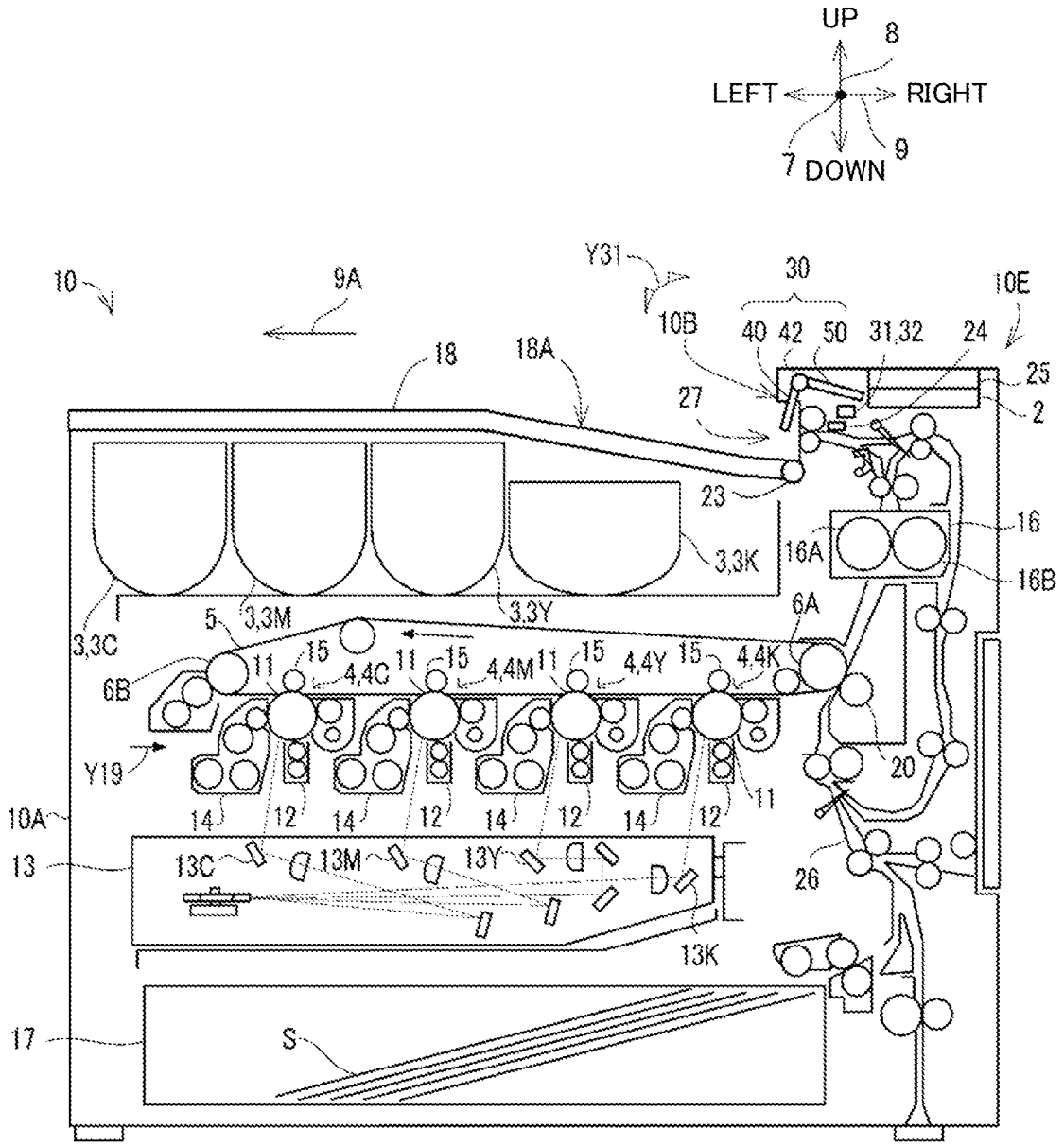
FIG. 1 shows a configuration of a multifunctional peripheral according to a first embodiment of the present disclosure.

Description will be provided for a schematic configuration of an image forming apparatus 10 (one example of an image forming apparatus of the present disclosure) shown in FIG. 1 according to a first embodiment of the present disclosure. It should be noted that, for convenience of description, the vertical direction in a state (a state shown in FIG. 1) in which the image forming apparatus 10 is installed in a usable manner is defined as an up-down direction 8. In addition, a front-rear direction 7 (a direction perpendicular to the paper surface in FIG. 1) is defined using the surface shown in FIG. 1 in the installed state as the front surface. Furthermore, a right-left direction 9 is defined based on the front surface of the image forming apparatus 10 in the installed state.

The image forming apparatus 10 is a color printer including a control portion 2, multiple image forming units 4, an intermediate transfer belt 5, a laser scanning unit 13, a secondary transfer roller 20, a fixing device 16, a sheet tray 18 (one example of a sheet tray of the present disclosure), a sheet feed cassette 17, an operation display portion 25, and a conveying route 26 (one example of a sheet discharge path of the present disclosure), etc. The image forming apparatus 10 forms a color image or a monochrome image on a sheet S based on inputted image data. The sheet S is a sheet material such as paper, a coated paper, a postcard, an envelope, and an OHP sheet. Other examples of the image forming apparatus according to the present disclosure include a facsimile, a copy machine, and a multifunctional peripheral. The operation display portion 25 is a touch panel or the like on which various information are displayed in accordance with control instructions from the control portion 2, and to which various information are inputted for the control portion 2 in accordance with user operations.

Each of the image forming units 4 (4C, 4M, 4Y, 4K) is an electronic photograph type image forming unit that includes a photosensitive drum 11, a charging device 12, a developing device 14, a primary transfer roller 15, and a cleaning device (not shown), etc. The image forming units 4 are arranged side by side along a running direction (horizontal direction) of the intermediate transfer belt 5, and form a so-called tandem type image forming unit. Specifically, toner images corresponding to C (cyan), M (magenta), Y (yellow), and K (black) are respectively formed in an image forming unit 4C, an image forming unit 4M, an image forming unit 4Y, and an image forming unit 4K. From the downstream side of the running direction (arrow Y19 direction) of the intermediate transfer belt 5, the image forming unit 4C for cyan, the image forming unit 4M for magenta, the image forming unit 4Y for yellow, and the image forming unit 4K for black are sequentially arranged in a single line in this order.

The intermediate transfer belt 5 is an intermediate transfer member on which intermediate transfer of toner images having each color formed on the photosensitive drum 11 of each of the image forming units 4 is conducted. The intermediate transfer belt 5 is supported by a drive roller 6A and a driven roller 6B in a rotationally drivable manner. As a result of being supported by the drive roller 6A and the driven roller 6B, the intermediate transfer belt 5 can run (rotate) while having its surface make contact with the surface of each of the photosensitive drums 11. When the surface of the intermediate transfer belt 5 passes between the photosensitive drum 11 and the primary transfer roller 15, toner images are sequentially transferred and overlaid on the intermediate transfer belt 5 from each of the photosensitive drums 11. The laser scanning unit 13 includes a laser light source configured to emit laser light in each color, a polygon mirror for scanning the laser light, and mirrors 13C, 13M, 13Y, and 13K configured to emit the scanned laser light, etc. The laser scanning unit 13 forms an electrostatic latent image on each of the photosensitive drums 11 by irradiating the photosensitive drum 11 of each of the image forming units 4 with laser light based on inputted image data for each color.

In the image forming apparatus 10 formed as described above, with the following procedure, a color image is formed on the sheet S supplied from the sheet feed cassette 17 along the conveying route 26, and the sheet S after image formation is discharged onto the sheet tray 18. On the conveying route 26, various conveying rollers for conveying the sheet S loaded on the sheet feed cassette 17 to the sheet tray 18 via the secondary transfer roller 20 and the fixing device 16 are disposed.

First, in each of the image forming units 4, the photosensitive drum 11 is uniformly charged to a predetermined potential by the charging device 12. Next, an electrostatic latent image is formed on the surface of each of the photosensitive drums 11 by irradiating the surface of each of the photosensitive drums 11 by the laser scanning unit 13 with laser light based on the image data. The electrostatic latent image on each of the photosensitive drums 11 is developed (visualized) as a toner image in each color by each of the developing devices 14. To each of the developing devices 14, toner (developer) is supplied from a detachable toner container 3 (3C, 3M, 3Y, 3K) corresponding to each color.

Next, the toner image in each color formed on the photosensitive drum 11 of each of the image forming units 4 is overlaid and transferred onto the intermediate transfer belt 5 by each of the primary transfer rollers 15. With this, a color image based on the image data is formed on the intermediate transfer belt 5. Next, the color image on the intermediate transfer belt 5 is transferred onto the sheet S conveyed by the secondary transfer roller 20 from the sheet feed cassette 17 via the conveying route 26. The sheet S, on which the color image is transferred, is conveyed to the fixing device 16 by a conveying mechanism that is not shown. The fixing device 16 includes a heating roller 16A heated to a high temperature, and a pressure roller 16B disposed opposingly with respect to the heating roller 16A. The sheet S conveyed to the fixing device 16 is conveyed while being nipped between the heating roller 16A and the pressure roller 16B. With this, the color image is melted and adhered to the sheet S. Then, the sheet S is discharged onto the sheet tray 18. It should be noted that any toner remaining on the surface of each of the photosensitive drums 11 is removed by each of the cleaning devices.

In the image forming apparatus 10, a contacting/separating mechanism (not shown) for bringing in contact or separating the intermediate transfer belt 5 with respect to the primary transfer roller 15 and the photosensitive drums 11 of the image forming units 4C, 4M, and 4Y is provided. When a monochrome image is printed in the image forming apparatus 10, the intermediate transfer belt 5 is separated from the primary transfer roller 15 and the photosensitive drums 11 of the image forming units 4C, 4M, and 4Y by the contacting/separating mechanism. With this, only a black toner image is transferred from the image forming unit 4K to the intermediate transfer belt 5, and a monochrome image is transferred on the sheet S from the intermediate transfer belt 5.

A housing 10A of the image forming apparatus 10 is a housing having an approximately rectangular parallelepiped shape as a whole. Each portion forming the image forming apparatus 10 is arranged within the housing 10A. At an upper part of the housing 10A, the sheet tray 18 that also serves as an upper cover of the housing 10A is provided. An upper housing chamber 10E is formed at the upper part of the housing 10A. The operation display portion 25, the control portion 2, and a sheet discharge mechanism of the conveying route 26 are housed in the upper housing chamber 10E. In addition, on a side wall surface 10B of the upper housing chamber 10E, a sheet discharge outlet 27 (one example of a sheet discharge outlet of the present disclosure), which is the end of the conveying route 26, is formed. The sheet discharge outlet 27 is an opening having a large width corresponding to the width direction (the front-rear direction 7) of the sheet tray 18 of the housing 10A. In a closed position described later, the sheet tray 18 extends out in a discharge direction 9A in which the sheet S is discharged from the sheet discharge outlet 27. The sheet S, on which an image is formed, is discharged onto the sheet tray 18 from the sheet discharge outlet 27, and is loaded on a sheet placement surface 18A of the sheet tray 18. It should be noted that the conveying route 26 is a route from the sheet feed cassette 17 to the sheet discharge outlet 27.

The image forming apparatus 10 shown in FIG. 1 includes an actuator 30 (one example of an actuator of the present disclosure), a detection portion 31 (one example of a detection portion of the present disclosure), and a stopper portion 24 (one example of a stopper member of the present disclosure). The actuator 30 rotates in a direction of an arrow Y31 in accordance with the load amount of sheets S loaded on the sheet tray 18. The detection portion 31 detects that a rotation position of the actuator 30 has reached a predetermined detection position 32 (one example of a detection position of the present disclosure). The stopper portion 24 restricts rotation of the actuator 30 through contact with the actuator 30. Details of the sheet tray 18, the stopper portion 24, the actuator 30, and the detection portion 31 will be described later.

The control portion 2 integrally controls the image forming apparatus 10. The control portion 2 is formed as a microcomputer including, as main components, a CPU, a ROM, a RAM, and an EEPROM, etc. Inside the image forming apparatus 10, the control portion 2 is connected to each of the image forming units 4, the secondary transfer roller 20, the fixing device 16, and the drive roller 6A, etc., and controls these components. In addition, the control portion 2 is connected to each element forming the image forming units 4, specifically, to the charging device 12, the laser scanning unit 13, the developing device 14, the primary transfer roller 15, and cleaning device, etc.

In the manner described above, the image forming apparatus 10 forms a color image on the surface of the intermediate transfer belt 5 by overlaying and transferring toner images in each color by the multiple image forming units 4 (4C, 4M, 4Y, 4K) on the intermediate transfer belt 5 that is running. Furthermore, the image forming apparatus 10 forms a color image on the sheet S by transferring the formed color image from the intermediate transfer belt 5 onto the sheet S by the secondary transfer roller 20. It should be noted that, in another embodiment, it is also conceivable to use the intermediate transfer belt 5 as a conveying belt, and overlay and transfer a color image directly on the sheet S conveyed on the conveying belt, or use a roller-like intermediate transfer member instead of the intermediate transfer belt 5.

[Replacement of Toner Container 3 and Opening and Closing of Sheet Tray 18]

Figure 2:
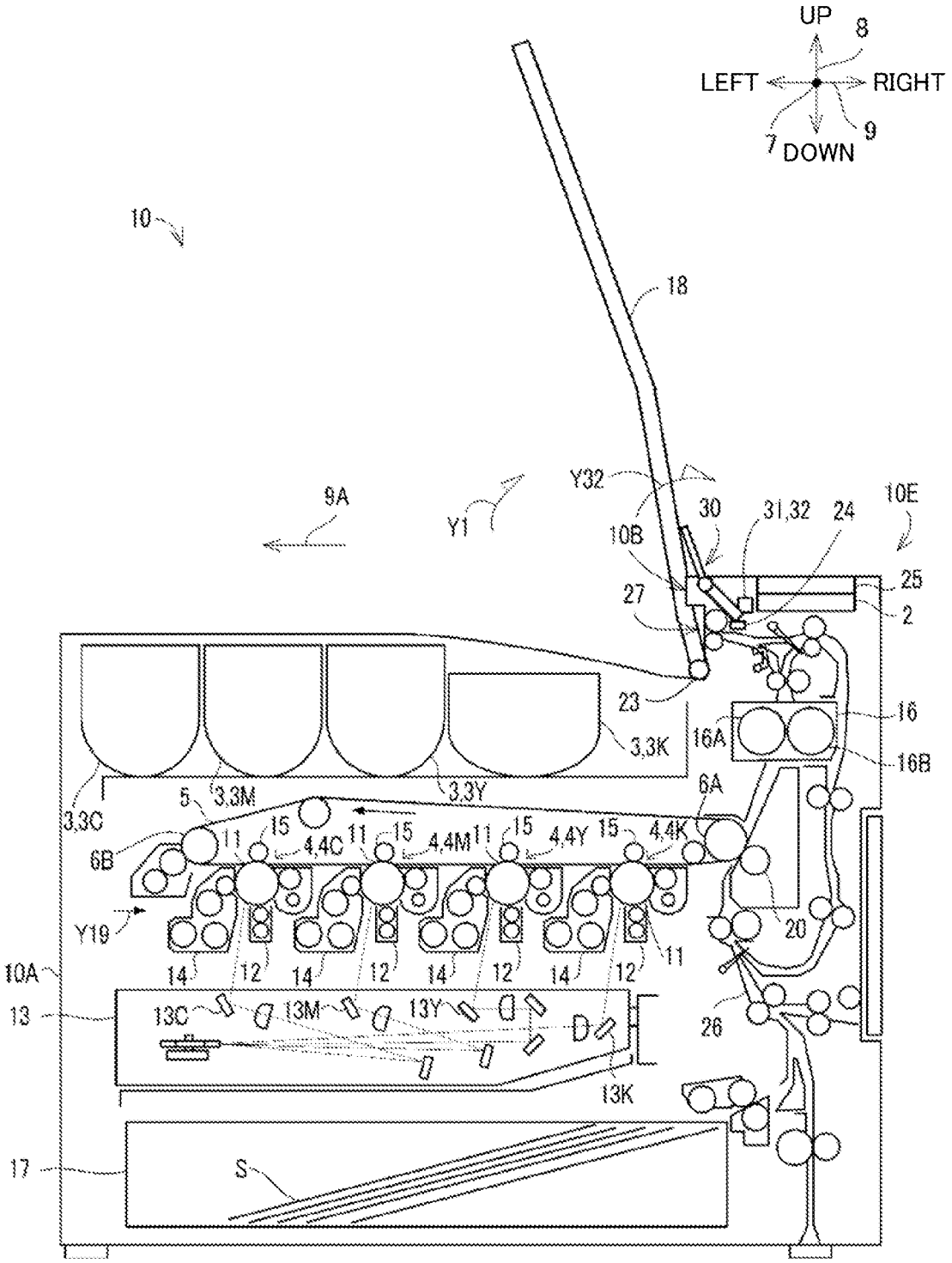
FIG. 2 shows a state in which a cover of the multifunctional peripheral is open.

Toner containers 3 include a toner container 3M for magenta, a toner container 3C for cyan, a toner container 3Y for yellow, and a toner container 3K for black, in accordance with the color developed in the image forming units 4. As shown in FIG. 2, in a manner corresponding to the image forming units 4 disposed side-by-side in the running direction (arrow Y19 direction) of the intermediate transfer belt 5, the toner containers 3 are also disposed side-by-side at the upper part of the housing 10A of the image forming apparatus 10. Each of the toner containers 3 is a replacement part that is freely detachable/attachable with respect to the image forming apparatus 10.

The sheet tray 18 also serves as the upper cover of the housing 10A of the image forming apparatus 10, and is opened and closed. The sheet tray 18 extends out from the sheet discharge outlet 27 in the discharge direction 9A in the closed position (position shown in FIG. 1) in which the sheet tray 18 is closed with respect to the housing 10A. The sheet tray 18 is inclined so as to be lower toward a side proximal to the sheet discharge outlet 27 and gradually higher in the discharge direction 9A. The sheet tray 18 is formed rotatable, using a cover rotation portion 23 formed on a side toward the sheet discharge outlet 27 as a rotation fulcrum, between an open position configured to open the inside of the housing 10A and the closed position configured to close the inside of the housing 10A. Here, the open position is a position ranging between the closed position and a fully open position shown in FIG. 2. When the sheet tray 18 is rotated in the rotatable direction and set in the open position for the purpose of replacing the toner containers 3, respective upper parts of the toner containers 3 installed on the upper part side of the housing 10A are exposed. When a toner housed in one of the toner containers 3 for each color is consumed, a user can set the sheet tray 18 of the image forming apparatus 10 to the open position, and replace the toner container 3 that is empty of the toner, from above.

Figure 3B:
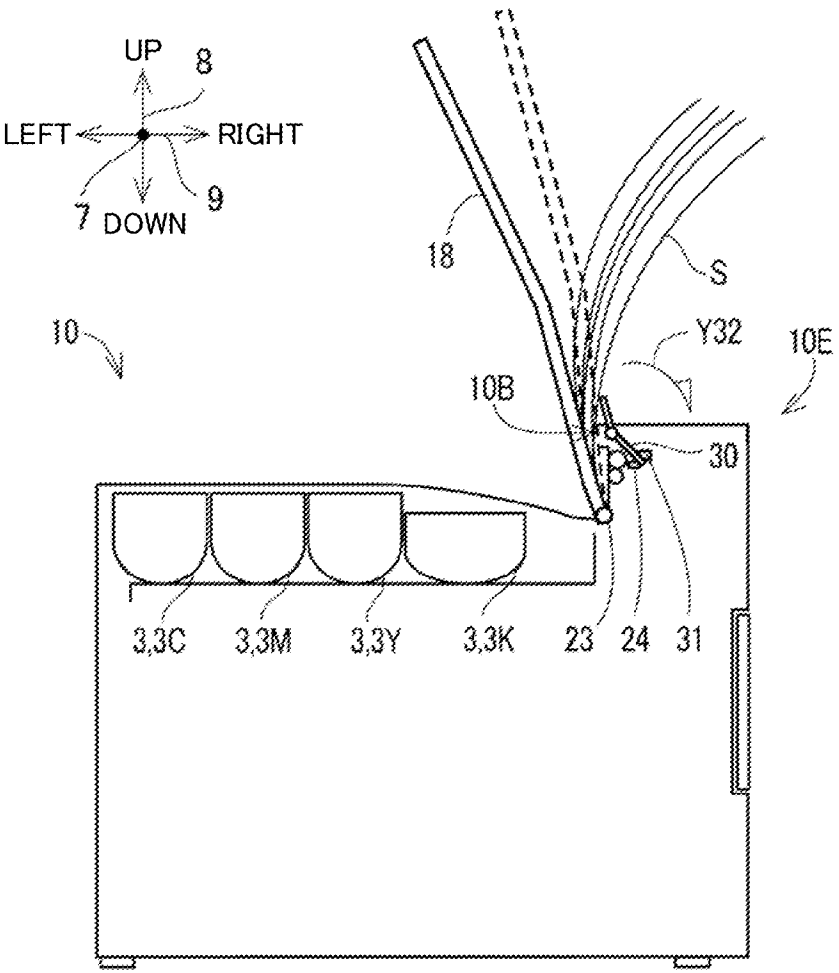
FIGS. 3A and 3B show states in which the cover of the multifunctional peripheral is opened and closed when sheets are loaded on a sheet tray.
Figure 3A:
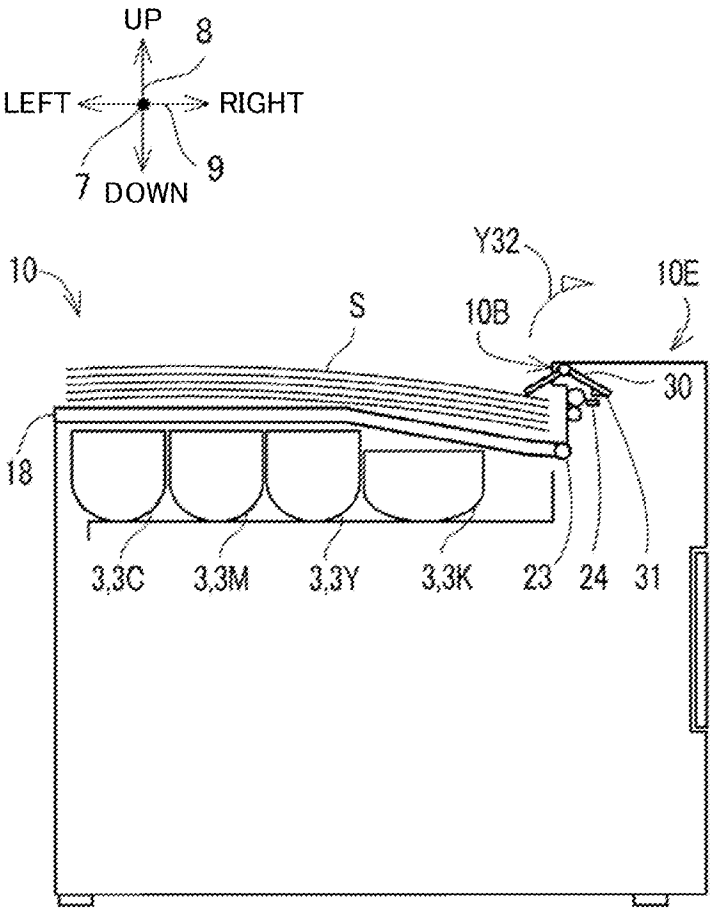

Generally, when replacing the toner container 3K for black located most closely to the cover rotation portion 23, the user opens the sheet tray 18 largely in the arrow Y1 direction for securing sufficient replacement space. At this moment, the rotated sheet tray 18 is rotatable until making contact with the side wall surface 10B of the upper housing chamber 10E formed on the upper part of the housing 10A. Hereinafter, the position where the sheet tray 18 makes contact with the side wall surface 10B is referred to as an acceptable limit position. The acceptable limit position is a rotation position of the sheet tray 18 when the sheet tray 18 is rotated to the fully open position (position shown in FIG. 2). When the sheet tray 18 is rotated to the acceptable limit position, the sheet placement surface 18A of the sheet tray 18 makes contact with the actuator 30. In this case, the actuator 30 is pushed by the sheet placement surface 18A and rotates in the same direction (arrow Y32). Thus, the actuator 30 is formed rotatable beyond the detection position 32. As shown in FIGS. 3A and 3B, sometimes the sheet tray 18 is set in the open position when sheets S are loaded on the sheet tray 18. In this case, the sheets S cover over the housing 10A to cause the actuator 30 to excessively rotate (see arrow Y32), and apply force on the actuator 30 in the rotation direction even after the rotation stops when the actuator 30 makes contact with the stopper portion 24 to cause damage to the actuator 30. In the present first embodiment, the actuator 30 is formed so as to prevent such damage, as described in the following.

[Actuator 30 and Detection Portion 31]

Figure 4C:
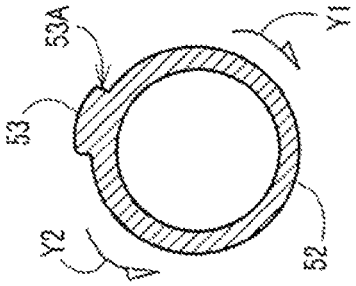
FIGS. 4A to 4C show a configuration of an actuator.
Figure 4B:
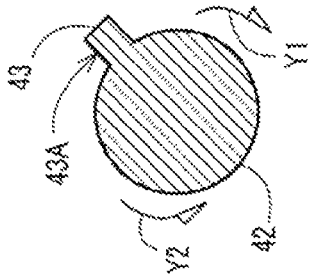
Figure 4A:
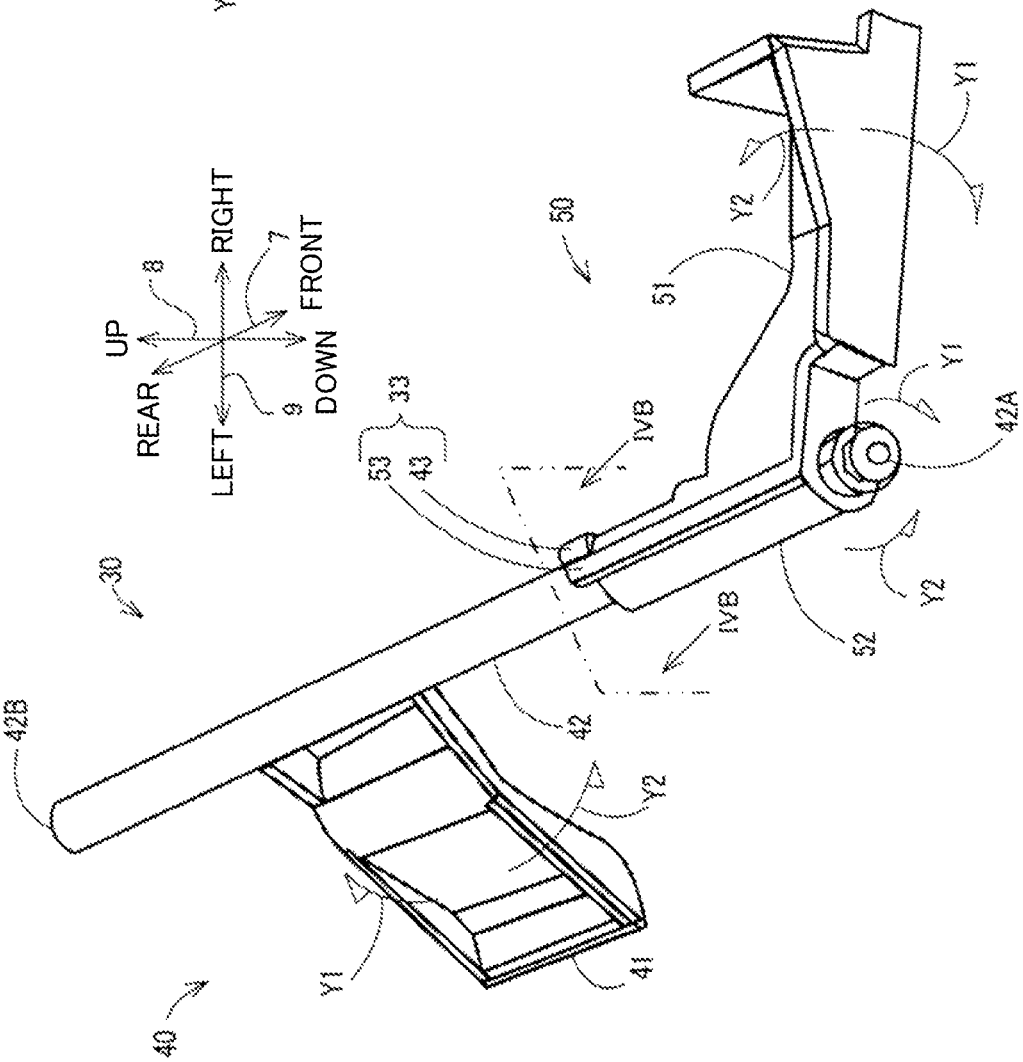

As shown in FIGS. 4A to 4C and 5A to 5F, the actuator 30 includes a first rotor 40 and a second rotor 50. FIG. 4A is a perspective view showing a configuration of the actuator 30. FIG. 4B is a cross sectional view showing a configuration of a rotation shaft 42 and a protruding portion 43. FIG. 4C is a cross sectional view showing a configuration of a cylindrical portion 52 and a contact portion 53.

As shown in FIG. 4A, the first rotor 40 includes a contactor 41 (one example of a contactor of the present disclosure), the rotation shaft 42 (one example of a first rotation shaft of the present disclosure), and the protruding portion 43 (one example of a protruding portion of the present disclosure). The rotation shaft 42 rotatably supports the actuator 30, and is arranged above the sheet discharge outlet 27 (see FIG. 1). The rotation shaft 42 has a cylindrical shape that elongates in the front-rear direction 7. Of the end portions of the rotation shaft 42, one that is in the front side and the other in the rear side in the front-rear direction 7 are an end portion 42A and an end portion 42B, respectively. The rotation shaft 42 is supported at two places by the housing 10A so as to be rotatable. The two places for support are a first support position located between the end portion 42A and the contactor 41 of the rotation shaft 42, and a second support position located between the end portion 42B and the contactor 41 of the rotation shaft 42.

The contactor 41 extends out from the rotation shaft 42 toward the sheet tray 18 side, and is formed integrally with the rotation shaft 42. In addition, the contactor 41 can rotate integrally with the rotation shaft 42 in a direction contacting/separating with respect to the sheet placement surface 18A of the sheet tray 18. Here, the contacting/separating direction is a direction (arrow Y2) in which the contactor 41 approaches the sheet placement surface 18A or a direction (arrow Y1) in which the contactor 41 separates away from the sheet placement surface 18A. When a sheet S is not loaded on the sheet tray 18, the contactor 41 makes contact with the sheet tray 18. When a sheet S discharged from the sheet discharge outlet 27 is loaded on the sheet tray 18, the contactor 41 rotates in a direction away from the sheet tray 18 in accordance with the load amount of the loaded sheets S. Based on the rotation of the contactor 41, the rotation shaft 42 rotates in the same direction by the same amount of rotation. In the manner described above, the contactor 41 is supported rotatably by the rotation shaft 42. Thus, when the sheet tray 18 is in the closed position, the contactor 41 makes contact with a topmost sheet S loaded on the sheet tray 18, and rotates in the up-down direction 8 in accordance with the load amount of the loaded sheet S. When the sheet tray 18 is in the open position, the contactor 41 makes contact with the sheet placement surface 18A of the sheet tray 18, and rotates in a direction identical to the direction in which the sheet tray 18 is rotated.

FIG. 4B shows the rotation shaft 42 in a cross sectional view at a section IVB-IVB in FIG. 4A. As shown in FIG. 4B, the protruding portion 43 is formed protruding in a direction perpendicular to an outer circumferential surface of the rotation shaft 42. The protruding portion 43 is formed integrally with the rotation shaft 42. Thus, based on the rotation of the contactor 41, the protruding portion 43 rotates in the same direction by the same amount of rotation. In addition, a position where the protruding portion 43 is formed is between the end portion 42A of the rotation shaft 42 and a position where the contactor 41 is provided on the rotation shaft 42, and is located forward in the front-rear direction 7 from the first support position.

As shown in FIG. 4A, the second rotor 50 includes a light-blocking piece 51 (one example of a detected member of the present disclosure), the cylindrical portion 52 (one example of a base end portion of the present disclosure), and the contact portion 53 (one example of a contact portion of the present disclosure). FIG. 4C shows the cylindrical portion 52 in a cross sectional view at the section IVB-IVB in FIG. 4A. The cylindrical portion 52 is elongated in the front-rear direction 7, and has a cylindrical cross-section shape in the up-down direction 8 and the right-left direction 9 as shown in FIG. 4C. The rotation shaft 42 is inserted through the cylindrical portion 52 such that the shaft center of the cylindrical portion 52 and the shaft center of the rotation shaft 42 match each other, and the cylindrical portion 52 is connected such that a part thereof through which the rotation shaft 42 is inserted is covered. The cylindrical portion 52 is rotatable about the rotation shaft 42. When the sheet tray 18 is in the closed position, associated with the rotation of the contactor 41, the cylindrical portion 52 rotates in a predetermined rotation direction integrally with the rotation shaft 42 while maintaining a predetermined angle. When the sheet tray 18 is in the open position, if the light-blocking piece 51 reaches the stopper portion 24, not the cylindrical portion 52 but only the rotation shaft 42 is rotated in the rotation direction to change the angle formed between the contactor 41 and the light-blocking piece 51. As shown in FIG. 4A, the contact portion 53 is formed on the outer circumferential surface of the cylindrical portion 52, has a shape extending toward the rear side in the front-rear direction 7 along the rotation shaft 42, and makes contact with the protruding portion 43 that rotates. The position where the protruding portion 43 is connected to the contact portion 53 is on the rear side of the light-blocking piece 51 in the front-rear direction 7, and is on the front side of the contactor 41 in the front-rear direction 7.

The light-blocking piece 51 is formed integrally with the cylindrical portion 52. The light-blocking piece 51 extends out from the cylindrical portion 52 in a direction perpendicular to the rotation shaft 42, is rotatable in response to rotation of the cylindrical portion 52, and is detected at the detection position 32 by the detection portion 31. The light-blocking piece 51 is disposed on the upstream side of the cylindrical portion 52 in the discharge direction 9A at an area separated from the conveying route 26 outwards in a shaft direction (forward direction in the front-rear direction 7) of the rotation shaft 42. Since the light-blocking piece 51 is disposed at an area outside the conveying route 26, the light-blocking piece 51 does not intersect with the conveying route 26. When the sheet S is not loaded on the sheet tray 18, the direction in which the light-blocking piece 51 extends is a direction inclined from the cylindrical portion 52 toward the upstream side in the discharge direction 9A. Until the light-blocking piece 51 reaches a predetermined stop position, the predetermined angle between the direction in which the light-blocking piece 51 extends from the cylindrical portion 52 and the direction in which the contactor 41 extends from the rotation shaft 42 is approximately 120 degrees. The shape of the front side surface of the light-blocking piece 51 in the front-rear direction 7 is formed in a sector-like shape in which an extension end side is wider than an end portion on the cylindrical portion 52 side. Furthermore, the detection position 32 where a light receiving portion of a photo sensor is arranged is set in the upstream side from the cylindrical portion 52 in the discharge direction 9A, within a range in which the light-blocking piece 51 can rotate. The sectorial-shaped extension end side of the light-blocking piece 51 is detected by the detection portion 31 when reaching the detection position 32 in accordance with the load amount of the sheets S loaded on the sheet placement surface 18A. When the sheet S is discharged from the sheet discharge outlet 27, the contactor 41, which makes contact with the sheet S discharged in the discharge direction 9A, oscillates in the discharge direction 9A (right-left direction 9). Since the predetermined angle between the extending direction of the light-blocking piece 51 and the extending direction of the contactor 41 is approximately 120 degrees, the oscillation of the contactor 41 is conveyed to the light-blocking piece 51 in an altered direction, and the light-blocking piece 51 rotates in an oscillating manner in the up-down direction 8. Since an end portion of the light-blocking piece 51 has a sector-like shape, a state in which light is blocked can be maintained even when the light-blocking piece 51 rotates beyond the detection position 32.

The detection portion 31 includes a light receiving portion and a light emitting portion of a photo sensor that is not shown. The detection position 32, where the detection portion 31 detects the extension end side of the light-blocking piece 51 when the sheet tray 18 is in the closed position, is set at a position indicating that a full-load amount of the sheets S loaded on the sheet placement surface 18A has been reached. The light-blocking piece 51, when positioned between the light emitting portion and the light receiving portion, blocks light emitted from the light emitting portion. The light receiving portion disposed at the detection position 32 outputs to the control portion 2 a signal indicating whether or not the amount of inputted light is smaller than a predetermined threshold. The light-blocking piece 51 rotates in the up-down direction 8 in accordance with the load amount of the sheets S loaded on the sheet placement surface 18A of the sheet tray 18. Thus, when extension end of the light-blocking piece 51 that rotates in association with the rotation of the contactor 41 reaches the detection position 32 indicating a fully loaded state, the light-blocking piece 51 blocks the light from the light emitting portion. The light receiving portion receiving an amount of light that is smaller than the threshold outputs, to the control portion 2, a signal indicating that the amount of light is smaller than the threshold. With the signal from the light receiving portion, the control portion 2 detects the full-load amount of the sheets S in the sheet tray 18. It should be noted that the position of the light receiving portion may be any position as long as the light-blocking piece 51 reaching the predetermined detection position 32 is detectable. For example, the detection position 32 of the light receiving portion may be a position indicating a half-load amount or a position indicating a one-third load amount of the sheets S.

A connecting mechanism 33 (one example of a connection portion of the present disclosure) is formed by the protruding portion 43 and the contact portion 53. As shown in FIG. 4A, the contact portion 53 applies a first force, generated by the weight of the light-blocking piece 51 in a first rotation direction (arrow Y1) of rotating from the detection position 32 to the stop position, on the protruding portion 43. The protruding portion 43 applies, on the contact portion 53, a second force, generated by the weight of the contactor 41, of causing the contactor 41 to move toward the sheet placement surface 18A (a force in a second rotation direction (arrow Y2) which is an opposite rotation direction of the first rotation direction). Since the protruding portion 43 is disposed on the downstream side of the contact portion 53 in the rotation direction of the first rotation direction, the contact portion 53 makes contact with the protruding portion 43 on the first rotation direction side. A surface 43A of the protruding portion 43 on the second rotation direction side shown in FIG. 4B, and a surface 53A of the contact portion 53 on the first rotation direction side shown in FIG. 4C make contact with each other. Since the weight of the contactor 41 is larger than the weight of the light-blocking piece 51, the second force applied in the second rotation direction generated by the weight of the contactor 41 is larger than the first force applied in the first rotation direction generated by the weight of the light-blocking piece 51. When the sheet tray 18 is in the closed position, the second force generated by the weight of the contactor 41 becomes large enough to ignore the effect of the first force generated by the weight of the light-blocking piece 51. Thus, in a stationary state in which the rotation of the contactor 41 by its weight is stopped, the contactor 41 maintains the stationary state in a state in which the first force in the first rotation direction is applied to the protruding portion 43 from the contact portion 53. In other words, in a state where the first force, generated by the weight of the light-blocking piece 51 in the first rotation direction Y1 of causing the light-blocking piece 51 to move from the detection position 32 toward the stop position, is applied on the protruding portion 43 from the contact portion 53, the contactor 41 maintains the stationary state in which a rotation thereof is stopped. Thus, when the protruding portion 43 is rotated by the rotation of the contactor 41, the contact portion 53 rotates by the weight of the light-blocking piece 51 until making contact with the protruding portion 43. In this manner, the rotation of the light-blocking piece 51 depends on the rotation of the contactor 41. In other words, the connecting mechanism 33 integrally rotates the rotation shaft 42 and the cylindrical portion 52 in the first rotation direction or the second rotation direction while maintaining the predetermined angle between the contactor 41 and the light-blocking piece 51. The connecting mechanism 33 integrally rotates the rotation shaft 42 and the cylindrical portion 52 in the first rotation direction or the second rotation direction until the light-blocking piece 51 reaches the stop position beyond the detection position 32 in response to the rotation of the contactor 41. Specifically, when the sheet tray 18 is in the closed position, the contactor 41 rotates in accordance with the load amount of the sheets S loaded on the sheet placement surface 18A. Associated with this, the position of the protruding portion 43 also moves in the second rotation direction. The light-blocking piece 51 rotates associated with the contactor 41 until the light-blocking piece 51 reaches the stop position and other force is applied thereto.

The stopper portion 24 is formed on the housing 10A, and is a member that stops rotation of the light-blocking piece 51 from the stop position in the first rotation direction when making contact with the light-blocking piece 51 that has rotated to the stop position. The position of the stopper portion 24 is a position where the light-blocking piece 51 does not make contact with the stopper portion 24 even when the sheet tray 18 on which the sheet S is not loaded is set in the open position and rotated to the acceptable limit position. On the other hand, the location of the stopper portion 24 is a position where the light-blocking piece 51 makes contact with the stopper portion 24 when the sheet tray 18 on which a predetermined amount of the sheets S is loaded is set in the open position and rotated to the limit. The force in the second rotation direction applied from the stopper portion 24 to the light-blocking piece 51 through contact is also applied to the contact portion 53 that is integrally formed with the light-blocking piece 51. Thus, when the light-blocking piece 51 reaches the stop position, the surface 43A on the second rotation direction side of the protruding portion 43 separates from the surface 53A on the first rotation direction side of the contact portion 53, and only the contactor 41 becomes rotatable in the first rotation direction.

[Operation of Actuator 30 and Connecting Mechanism 33]

Figure 5A:
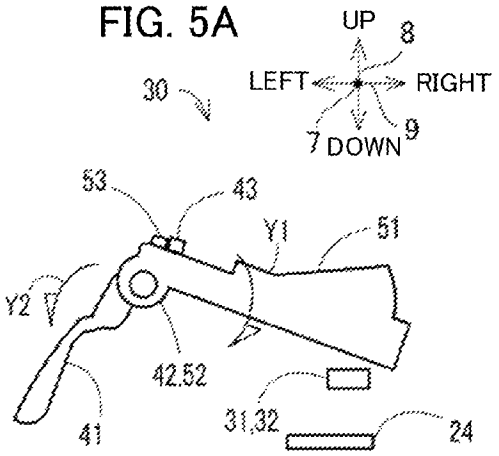
FIGS. 5A to 5F are schematic diagrams showing rotation states of the actuator.

Operation of the actuator 30 and the state of the connecting mechanism 33 will be described with reference to FIGS. 5A to 5F. FIGS. 5A to 5F show operating states of the actuator 30. FIGS. 5C to 5E show operation of the actuator 30 and the states of the connecting mechanism 33 when the sheet tray 18 is in the open position. As shown in FIG. 5A, the second force in the second rotation direction (arrow Y2) generated by the weight of the contactor 41 is larger than the first force in the first rotation direction (arrow Y1) generated by the weight of the light-blocking piece 51. The protruding portion 43 receives the force in the second rotation direction generated by the weight of the contactor 41, and presses the contact portion 53 in the second rotation direction. On the other hand, the contact portion 53 receives the force in the first rotation direction generated by the weight of the light-blocking piece 51, and presses the protruding portion 43 in the first rotation direction. In this manner, forces in mutually opposite directions are applied on the protruding portion 43 and the contact portion 53 forming the connecting mechanism 33, and the rotation shaft 42 and the cylindrical portion 52 integrally rotate since the protruding portion 43 and the contact portion 53 are connected. The rotation of the rotation shaft 42 and the cylindrical portion 52 depends on the rotation of the contactor 41 that has a large weight. When the protruding portion 43 is rotated by the rotation force of the contactor 41, the light-blocking piece 51 is rotated until the contact portion 53 makes contact with the protruding portion 43. Thus, when the sheet tray 18 is in the closed position, the light-blocking piece 51 rotates in accordance with the load amount of the sheets S on the sheet tray 18 while maintaining the predetermined angle between the contactor 41 and the light-blocking piece 51. When the contactor 41 rotates in the first rotation direction (arrow Y1) away from the sheet placement surface 18A, the connected light-blocking piece 51 rotates in the same direction. Conversely, when the contactor 41 rotates in the second rotation direction (arrow Y2) toward the sheet placement surface 18A, the connected light-blocking piece 51 also rotates in the same direction. In this manner, the actuator 30 including the contactor 41 and the light-blocking piece 51, etc., is rotated in accordance with the load amount of the sheets S loaded on the sheet tray 18.

Figure 5B:
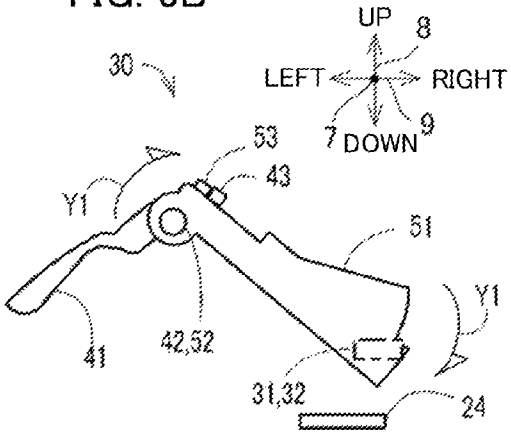
Figure 5C:
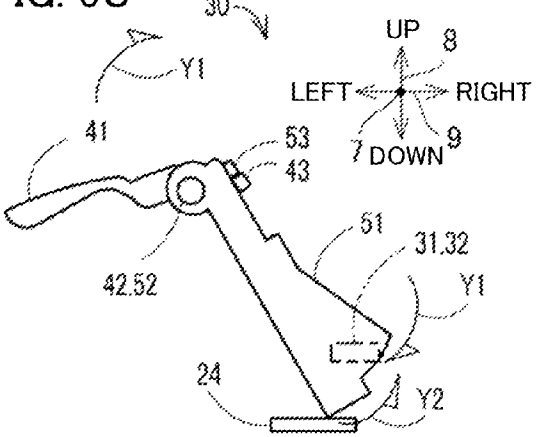
Figure 5D:
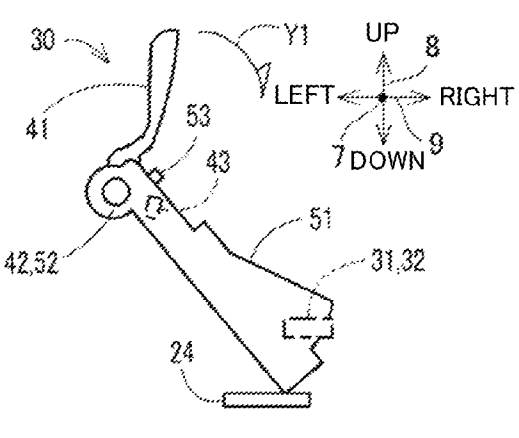
Figure 5E:
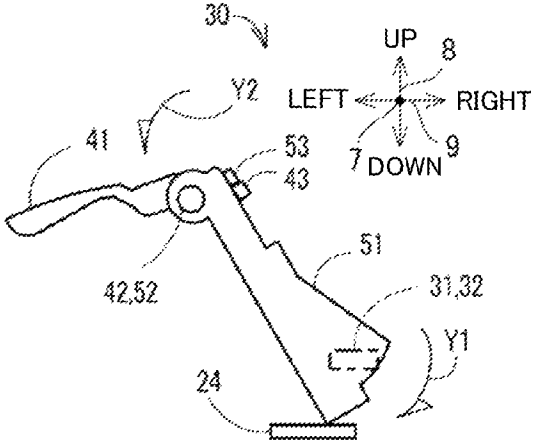

Furthermore, as shown in FIG. 5B, when the load amount of the sheets S loaded on the sheet tray 18 increases, the contactor 41 rotates in the first rotation direction (arrow Y1) accordingly. The connected light-blocking piece 51 also rotates in the first rotation direction (arrow Y1). When the full-load amount of the sheets S is reached, the contactor 41 rotates to a position reached in the fully loaded state accordingly. The connected light-blocking piece 51 also blocks the light receiving portion of the detection portion 31 at the predetermined detection position 32 that is reached in the fully loaded state. The detection portion 31 that has been able to only detect an amount of light equal to or smaller than the predetermined amount from the light receiving portion, outputs to the control portion 2 a signal indicating that the sheet tray 18 is fully loaded.

Next, as shown in FIG. 5C, when the sheet tray 18 is set in the open position, the contactor 41 makes contact with the sheet placement surface 18A, and rotates in the first rotation direction (arrow Y1). Associated with the rotation of the contactor 41, the light-blocking piece 51 also rotates in the first rotation direction (arrow Y1). When the sheet tray 18 is rotated to the limit when the sheet tray 18 is loaded with the sheets S, the contactor 41 is rotated in the first rotation direction (arrow Y1) excessively by the level of the load amount of the sheets S. Associated with this, the light-blocking piece 51 is also rotated in the first rotation direction (arrow Y1). If the load amount of the sheets S on the sheet tray 18 is equal to or larger than a predetermined load amount, the light-blocking piece 51 is rotated beyond the detection position 32 until reaching the stopper portion 24 disposed at the stop position. When the light-blocking piece 51 makes contact with the stopper portion 24, the contact portion 53 receives a new force in the second rotation direction (arrow Y2) from the light-blocking piece 51. The sum of the new force through the contact with the light-blocking piece 51 and the second force in the second rotation direction (arrow Y2) generated by the weight of the contactor 41 applied from the protruding portion 43 on the contact portion 53, becomes larger than the first force in the first rotation direction (arrow Y1) generated by the weight of the light-blocking piece 51 applied on the contact portion 53. Thus, when the light-blocking piece 51 reaches the stop position, only the rotation shaft 42 is rotated in the first rotation direction (arrow Y1) while the light-blocking piece 51 is stopped at the stop position to change the angle formed between the contactor 41 and the light-blocking piece 51. In this manner, the connecting mechanism 33 integrally connects the rotation shaft 42 and the cylindrical portion 52 in the first rotation direction (arrow Y1) and the second rotation direction (arrow Y2) until the light-blocking piece 51 reaches the position of the stopper portion 24 beyond the detection position 32. Furthermore, when the light-blocking piece 51 reaches the position of the stopper portion 24 beyond the detection position 32, the connecting mechanism 33 connects the rotation shaft 42 and the cylindrical portion 52 so as to rotate only the rotation shaft 42 in the first rotation direction (arrow Y1) while keeping the light-blocking piece 51 stopped at the stop position.

As shown in FIG. 5D, when the sheet tray 18 is set in the fully open position, the light-blocking piece 51 makes contact with the stopper portion 24 and is prevented from rotating further in the first rotation direction (arrow Y1). On the other hand, associated with the rotation of the sheet tray 18, the contactor 41 is rotated in the first rotation direction (arrow Y1) to the acceptable limit position of the sheet tray 18. If the load amount of the sheets S loaded on the sheet tray 18 is equal to or larger than the predetermined load amount, the contactor 41 is rotated in the first rotation direction (arrow Y1) to the acceptable limit position. In this case, the connecting mechanism 33 rotates only the rotation shaft 42 in the first rotation direction (arrow Y1) to change the angle formed between the contactor 41 and the light-blocking piece 51. Thus, even when the sheets S are loaded on the sheet tray 18 in an amount equal to or larger than the predetermined load amount, unanticipated force is not applied on the contactor 41, the connecting mechanism 33, and the light-blocking piece 51, etc., included in the actuator 30. In other words, there is no fear of the actuator 30 being damaged as a result of an unanticipated force being applied on the actuator 30 when the actuator 30 makes contact with the stopper portion 24.

As shown in FIG. 5E, when the sheet tray 18 is shifted from the open position to the closed position and rotated in the second rotation direction (arrow Y2), the contactor 41 is rotated in the second rotation direction (arrow Y2) by its own weight. Associated with the rotation of the contactor 41 in the second rotation direction (arrow Y2), the contact portion 53 makes contact with the protruding portion 43 and the contact between the light-blocking piece 51 and the stopper portion 24 is released. The connecting mechanism 33 enters a state of being subjected only to the second force in the second rotation direction (arrow Y2) generated by the weight of the contactor 41 from the protruding portion 43 on the contact portion 53, and the first force in the first rotation direction (arrow Y1) generated by the weight of the light-blocking piece 51 from the contact portion 53 on the protruding portion 43. The second force is larger than the first force. Thus, the protruding portion 43 and the contact portion 53 can integrally rotate associated with the rotation of the contactor 41 while maintaining the predetermined angle. The contactor 41 and the light-blocking piece 51 become connected and are rotated in the same second rotation direction (arrow Y2). Thus, the light-blocking piece 51 is moved from the stop position, where the stopper portion 24 is disposed, upward in the up-down direction 8.

Figure 5F:
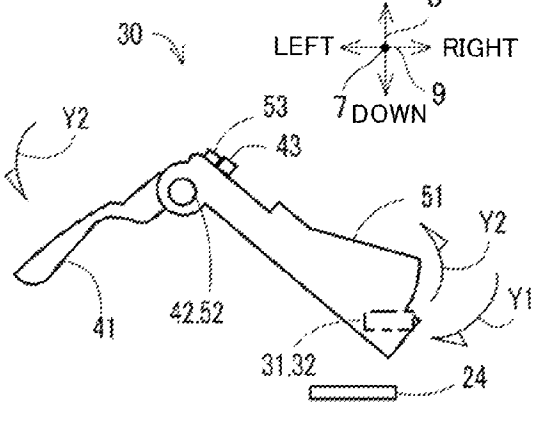

As shown in FIG. 5F, when the sheet tray 18 is set in the closed position, the contactor 41 and the light-blocking piece 51 connected by the connecting mechanism 33 integrally rotate in the same direction while maintaining the predetermined angle. When a sheet S is not loaded on the sheet tray 18, the contactor 41 and the light-blocking piece 51 rotate in the second rotation direction (arrow Y2). When a sheet S is loaded on the sheet tray 18, the contactor 41 and the light-blocking piece 51 rotate in the first rotation direction (arrow Y1) in accordance with the load amount of the sheets S. As described above, the connecting mechanism 33 integrally rotates the rotation shaft 42 and the cylindrical portion 52 in the first rotation direction (arrow Y1) and the second rotation direction (arrow Y2) while maintaining the angle formed between the contactor 41 and the light-blocking piece 51.

When the light-blocking piece 51 reaches the stop position, the connecting mechanism 33 rotates only the rotation shaft 42 in the first rotation direction (arrow Y1) to change the predetermined angle between the contactor 41 and the light-blocking piece 51. As a result, the connecting mechanism 33 prevents damage to the actuator 30 even when the contactor 41 of the actuator 30 is excessively rotated. In addition, since it is possible to integrally rotate the contactor 41 and the light-blocking piece 51 while maintaining the predetermined angle therebetween, the connecting mechanism 33 enables the light-blocking piece 51 to consistently rotate to the detection position 32 when the load amount of the sheets S loaded on the sheet tray 18 reaches full.

[Advantageous Effects of First Embodiment]

As described above, with the image forming apparatus 10 of the first embodiment of the present disclosure, even when the actuator 30 for detecting the sheets S loaded on the sheet tray 18 is rotated beyond an acceptable range, damage thereto can be prevented. In addition, the configuration of the actuator 30 can be achieved by a simple configuration of connecting two members, i.e., the first rotor 40 and the second rotor 50, using their own weight.

Second Embodiment

Hereinafter, a second embodiment of the present disclosure will be described. In the description of the first embodiment described above, although a case has been described in which the actuator 30 is formed from the two members of the first rotor 40 and the second rotor 50, the present disclosure is not limited thereto. The rotation force of the first rotor 40 may be transmitted to the light-blocking piece 51 not directly but indirectly via another member. For example, instead of the second rotor 50, a first member 61 on which the cylindrical portion 52 and the contact portion 53 are formed, and a second member 62 on which the light-blocking piece 51 is formed may be included. This is particularly useful when space for arranging the detection portion 31 and the detection position 32, etc., in the vicinity of the cover rotation portion 23 is insufficient. In the second embodiment of the present disclosure, a transmission mechanism 60 (one example of a transmission portion of the present disclosure) configured to indirectly transmit the rotation force of the first rotor 40 to the light-blocking piece 51 via the other member has to be included. In the following description of the second embodiment of the present disclosure, portions that are different from those in the first embodiment of the present disclosure will be described, and description of configurations of common portions will be omitted.

[Configuration of Actuator 30A]

Figure 6A:
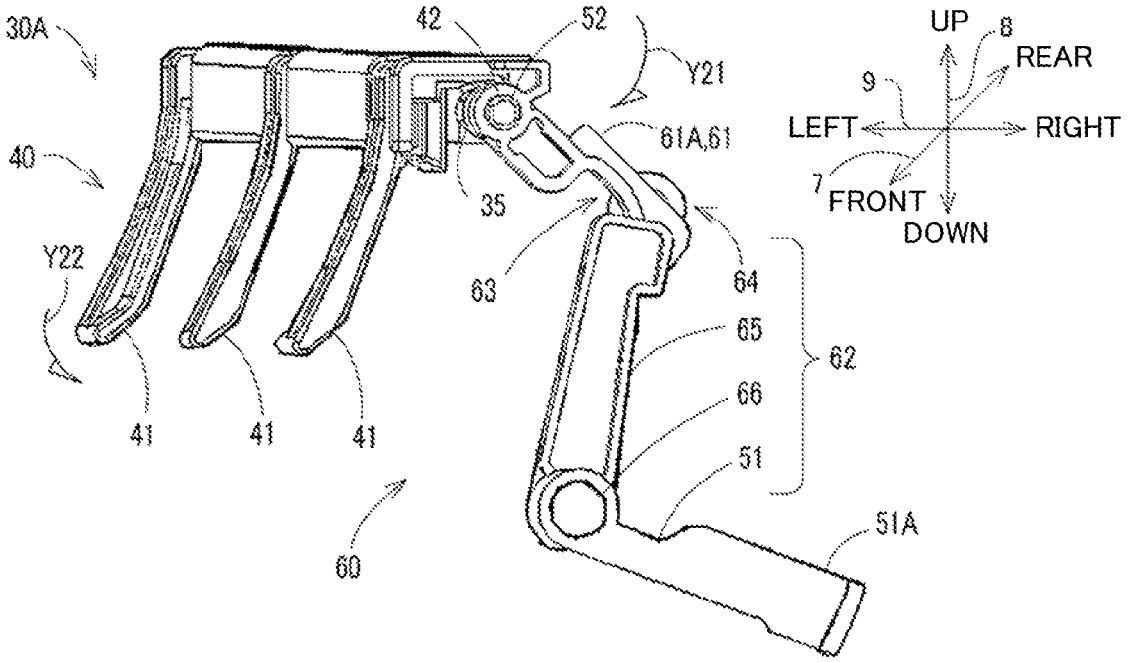
FIGS. 6A and 6B are perspective views showing a configuration of an actuator including three members, according to a second embodiment of the present disclosure.
Figure 6B:
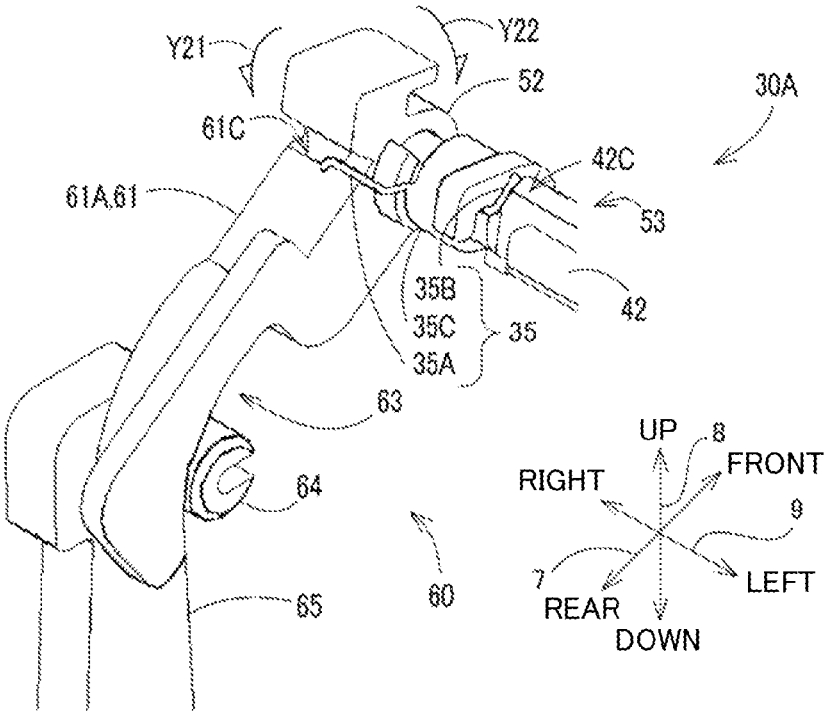
Figure 7:
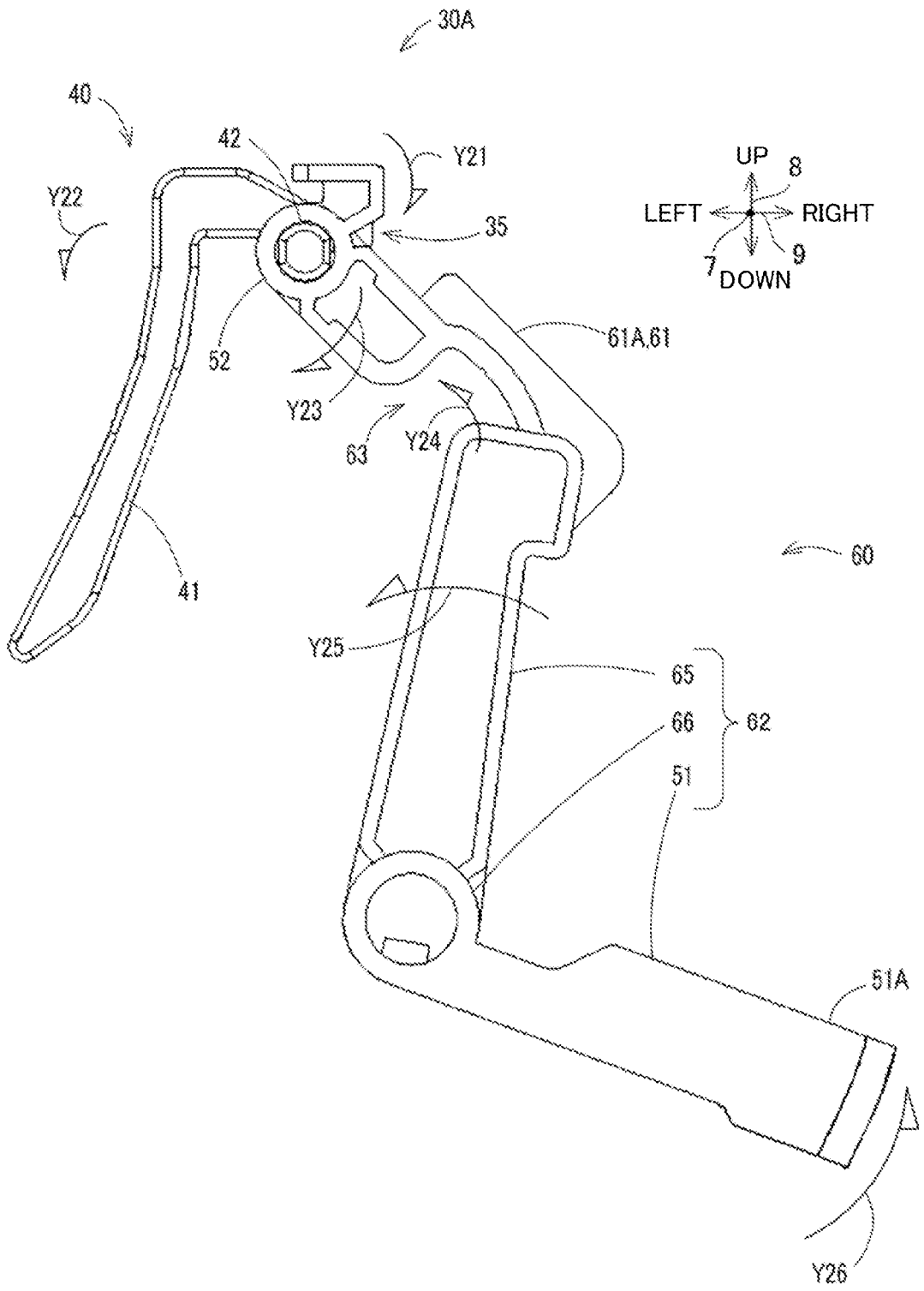
FIG. 7 shows a configuration of the actuator including three members.

FIGS. 6A and 6B are perspective views of the front surface side and the rear surface side of an actuator 30A according to the second embodiment, respectively. FIG. 7 is a side view of the actuator 30A. As shown in FIGS. 6A, 6B, and 7, the actuator 30A includes the first rotor 40, the first member 61, the second member 62, and a torsion coil spring 35 (one example of an elastic support portion of the present disclosure).

The first rotor 40 includes three contactors 41, the rotation shaft 42, and the protruding portion 43. By having three of the contactors 41, the force generated by the weight of the contactors 41 and applied to the sheet S is dispersed, and impact on the sheet S is reduced.

The first member 61 includes the cylindrical portion 52, the contact portion 53, and a first arm 61A (one example of a first arm of the present disclosure). The first arm 61A extends out from the cylindrical portion 52 in a direction perpendicular to the rotation shaft 42, and a curved portion 63 (one example of a curved portion of the present disclosure) is formed thereon. The curved portion 63 is a curved portion concaved on an outer side surface in the first rotation direction (see arrow Y21) of the first arm 61A. The curved portion 63 is formed at a part toward the cylindrical portion 52 from the vicinity of an end portion opposite to the cylindrical portion 52 of the first arm 61A.

The second member 62 includes a curve contact portion 64, a second arm 65 (one example of a second arm of the present disclosure), the light-blocking piece 51 (one example of the detected member of the present disclosure), and a connecting shaft portion 66 (one example of a second rotation shaft of the present disclosure). The shape of the second member 62 in a front surface side view in the front-rear direction 7 is approximately an L-letter shape. The connecting shaft portion 66 is disposed downward in the up-down direction 8 of the rotation shaft 42 and the cylindrical portion 52, and the second member 62 is disposed so as to be rotatable about the connecting shaft portion 66. The second arm 65 has one end thereof extended out from the connecting shaft portion 66 toward the curved portion 63 of the first member 61. The second arm 65 has the curve contact portion 64 formed on the other extension end where contact is made with the curved portion 63 of the first member 61. The curve contact portion 64 has a cylindrical shape extending in the front-rear direction 7. The light-blocking piece 51 is connected to the second arm 65 by the connecting shaft portion 66, and extends out from the connecting shaft portion 66 in a direction different from that of the second arm 65. On an extension end 51A of the light-blocking piece 51, a detection-target portion that is to be detected by the detection portion 31 at the detection position 32 is formed.

As shown in FIG. 6B, the torsion coil spring 35 is disposed between the rotation shaft 42 and the cylindrical portion 52. Together with the connecting mechanism 33, the torsion coil spring 35 supports the rotation shaft 42 and the cylindrical portion 52 so as to maintain the angle therebetween at the predetermined angle. The torsion coil spring 35 includes a first spring arm 35A, a second spring arm 35B, and a roll main body 35C. The first spring arm 35A is locked to a locking portion 61C disposed on the outer side surface of the first member 61. The first spring arm 35A transmits elastic force to the cylindrical portion 52 and the first member 61, but instead receives rotation force from the cylindrical portion 52 and the first member 61. The second spring arm 35B is locked to a locking portion 42C that protrude from the rotation shaft 42 in a diameter direction. The second spring arm 35B transmits elastic force to the rotation shaft 42, but instead receives rotation force from the rotation shaft 42. The roll main body 35C has an internal diameter that is larger than the rotation shaft 42, and has a hard steel wire or a piano wire wound thereto at a predetermined winding number and a predetermined pitch. In addition, the torsion coil spring 35 is formed such that the roll main body 35C is inserted through the rotation shaft 42, and its central axis is disposed coaxially with the rotation shaft 42 and the cylindrical portion 52. If the angle between the rotation shaft 42 and the cylindrical portion 52 is spread larger than the predetermined angle, the angle between the first spring arm 35A and the second spring arm 35B is also spread to be larger than the predetermined angle to deform the torsion coil spring 35. In this case, because of a restoring force of the torsion coil spring 35, a force to maintain the angle between the first spring arm 35A and the second spring arm 35B at the predetermined angle acts. The torsion coil spring 35 is disposed such that the rotation shaft 42 and the cylindrical portion 52 can integrally rotate until the light-blocking piece 51 reaches the stop position. The torsion coil spring 35 elastically supports the rotation shaft 42 and the cylindrical portion 52 via the roll main body 35C so as to maintain the angle between the rotation shaft 42 and the cylindrical portion 52 at the predetermined angle. Balance of forces of the contactors 41, the first member 61, and the second member 62 is adjusted by the elastic force of the torsion coil spring 35 to maintain the predetermined angle between connected members to be constant. For example, when the sheet tray 18 is set in the fully open position, the extension end 51A of the light-blocking piece 51 makes contact with the stopper portion 24 to prevent rotation of the first member 61 and the second member 62 and rotate only the contactors 41 on which force is applied by the sheet tray 18. When the sheet tray 18 is set in the closed position and a force that rotates the contactors 41 is not applied, the elastic force of the torsion coil spring 35 causes the contactors 41, the first member 61, and the second member 62 to connect to each other, and the predetermined angle among the members can be restored to be constant.

The transmission mechanism 60 configured to transmit rotation force of the contactors 41 and the rotation shaft 42 to the light-blocking piece 51 is formed by the first member 61, the second member 62, and the torsion coil spring 35. The transmission mechanism 60 is disposed between the rotation shaft 42 and the light-blocking piece 51, transmits the rotation force of the rotation shaft 42 to the light-blocking piece 51, and interlocks the light-blocking piece 51 and the rotation shaft 42. Specifically, when the connecting mechanism 33 causes the rotation shaft 42 and the cylindrical portion 52 to be integrally rotatable, the transmission mechanism 60 rotates the first arm 61A associated with the rotation of the rotation shaft 42. In addition, by the rotation of the first arm 61A, the curved portion 63 moves the curve contact portion 64 which is the extension end of the second arm 65 in the first rotation direction, and rotates the second arm 65 about the connecting shaft portion 66. As a result, the extension end 51A of the light-blocking piece 51 connected integrally with the second arm 65 is moved toward the stop position.

[Operation of Actuator 30A]

Operation of the actuator 30A and the connecting mechanism 33 will be described with reference to FIGS. 7 and 8A to 8D. FIGS. 8C and 8D show operations of the actuator 30 and the state of the connecting mechanism 33 when the sheet tray 18 is in the open position. As shown in FIG. 7, the second force in the second rotation direction (see arrow Y22) generated by the weight of the contactors 41 is larger than the first force in the first rotation direction (see arrow Y21) generated by the weight of the first arm 61A. The angle between the rotation shaft 42 and the cylindrical portion 52 when the contact portion 53 makes contact with the protruding portion 43 is the predetermined angle. The torsion coil spring 35 supports the rotation shaft 42 and the cylindrical portion 52 so as to maintain the predetermined angle. When the light-blocking piece 51 is not in contact with the stopper portion 24, the elastic force of torsion coil spring 35 is larger than the force applied on the first arm 61A form the second member 62. Thus, the connecting mechanism 33 maintains the contact between the contact portion 53 and the protruding portion 43, and rotatably connects the rotation shaft 42 and the cylindrical portion 52 in an integral manner. In this case, the contact portion 53 and the protruding portion 43 receive forces from mutually different directions. The contact portion 53 connected to the protruding portion 43 is rotated in the same rotation direction as the protruding portion 43.

Figure 8A:
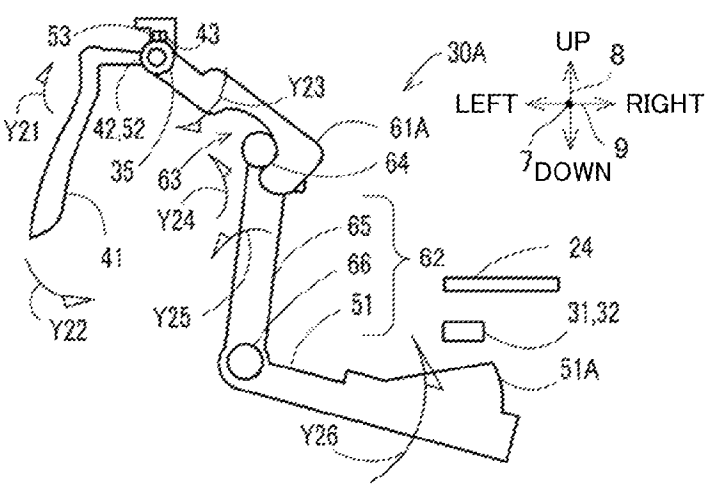
FIGS. 8A to 8D are schematic diagrams showing rotation states of the actuator including three members.

As shown in FIG. 8A, in the actuator 30A of the second embodiment, the protruding portion 43 is rotated in the first rotation direction (arrow Y21) by a rotation force in the first rotation direction (arrow Y21) of the contactors 41. The torsion coil spring 35 applies an elastic force on the contact portion 53 so as to maintain the predetermined angle, and rotates the contact portion 53 in the first rotation direction (arrow Y21) until making contact with the moved protruding portion 43. The first arm 61A is rotated in the first rotation direction (arrow Y23) by the rotation force of the contact portion 53. The rotation of the first arm 61A causes the curved portion 63 to move the curve contact portion 64 in the first rotation direction (arrow Y23). The curve contact portion 64 moves upward (arrow Y24) in the up-down direction 8 along the curved portion 63. The second member 62 rotates about the connecting shaft portion 66 by the force that moves the curve contact portion 64. The second arm 65 of the second member 62 moves leftward (arrow Y25) in the right-left direction 9, and the extension end 51A of the light-blocking piece 51 moves upward (arrow Y26) in the up-down direction 8 where the detection position 32 is located. In this manner, when the contactors 41 rotate in the first rotation direction (arrow Y21) away from the sheet placement surface 18A, the first member 61 including the first arm 61A rotates in the same direction (arrow Y23). On the other hand, since the curve contact portion 64 which is an extension end of the second arm 65 receives a rotation force from the curved portion 63 in a direction opposite to the first rotation direction, the second member 62 rotates in the second rotation direction about the connecting shaft portion 66. With this, the extension end 51A of the light-blocking piece 51, extending from the connecting shaft portion 66 in a direction different from that of the second arm 65, is pressed upward (arrow Y26) in the up-down direction 8.

It should be noted that, when the contactors 41 are rotated in the second rotation direction (arrow Y22) toward the sheet placement surface 18A, the first member 61 including the first arm 61A rotates in the same direction. On the other hand, in the second member 62, the force that the curve contact portion 64, which is an extension end of the second arm 65, receives from the curved portion 63 of the first arm 61A in the first rotation direction becomes small. On the other hand, since the second member 62 receives a force rotating in the first rotation direction generated by the weight of the light-blocking piece 51, the curve contact portion 64 moves in the second rotation direction while being in contact with the curved portion 63. With this, the extension end 51A of the light-blocking piece 51 is pressed downward in the up-down direction 8.

Figure 8B:
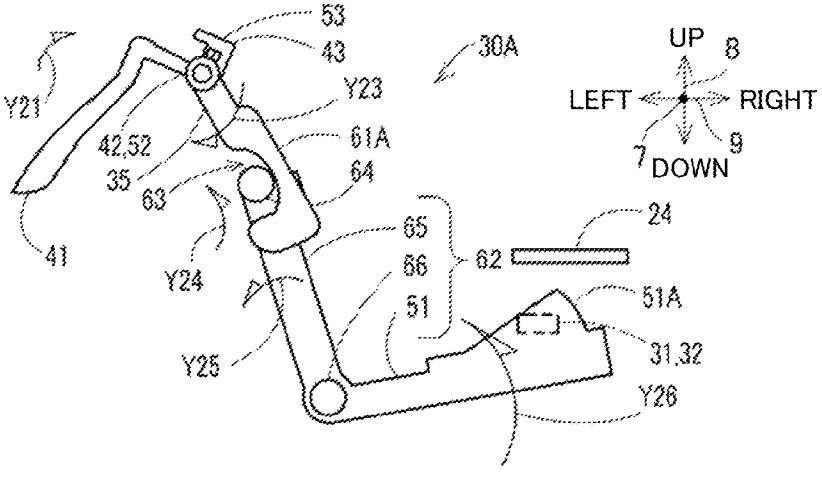
Figure 8C:
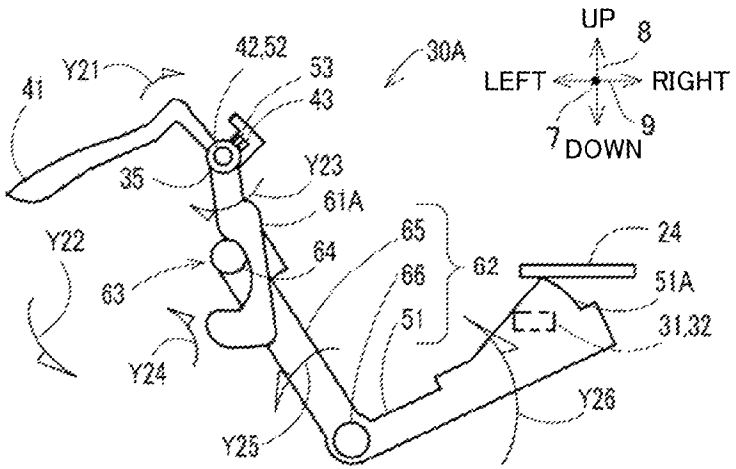
Figure 8D:
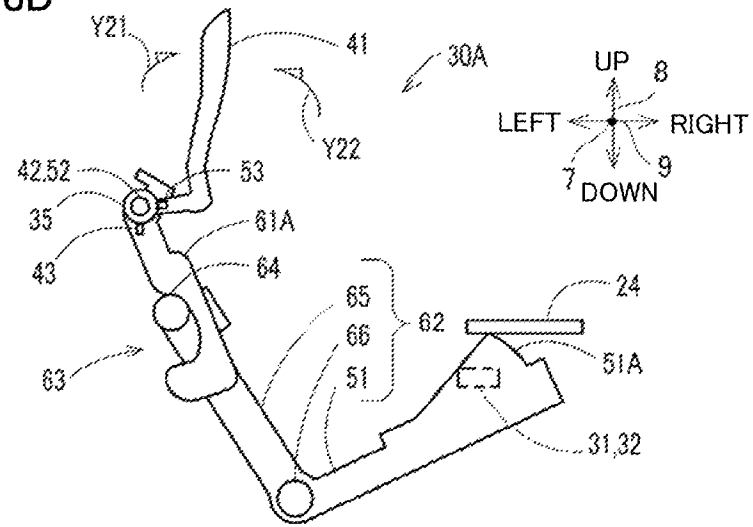

Furthermore, as shown in FIG. 8B, when a fully load amount of the sheets S is reached, the contactors 41 rotate to the position reached in the fully loaded state accordingly. The first member 61 including the first arm 61A is also moved to the position of the fully loaded state. The curve contact portion 64 that receives a force from the curved portion 63 of the first arm 61A moves in the center direction (arrow Y24) from the end portion of the first arm 61A along the curved portion 63. The movement of the curved portion 63 and the curve contact portion 64 causes the force from the first member 61 on the second member 62 to change direction. The extension end 51A of the light-blocking piece 51 is pressed in the upward direction (arrow Y26), reaches the predetermined detection position 32 of the fully loaded state, and blocks the light receiving portion of the detection portion 31. In this manner, the transmission mechanism 60 transmits the rotation force of the cylindrical portion 52 that rotates associated with the rotation of the contactors 41 to the light-blocking piece 51. In addition, the connecting mechanism 33 integrally rotates the rotation shaft 42 and the cylindrical portion 52 in the rotation direction while maintaining the predetermined angle between the contactors 41 and the light-blocking piece 51.

Next, as shown in FIG. 8C, when the sheet tray 18 is set in the open position, the contactors 41 make contact with the sheet placement surface 18A, and rotate in the same direction (arrow Y21). The protruding portion 43 formed integrally with the contactors 41 and the contact portion 53 connected to the protruding portion 43 rotate in the first rotation direction (arrow Y21) while maintaining the predetermined angle. Associated with the rotation of the protruding portion 43 and the contact portion 53, the first member 61 also rotates in the same direction (arrow Y23). The curve contact portion 64 moves upward (arrow Y24) in the up-down direction 8 along the curved portion 63 of the first arm 61A. The extension end 51A of the light-blocking piece 51 is pressed up in the upward direction (arrow Y26) associated with the rotation of the curve contact portion 64.

If the sheet tray 18 is rotated to the limit when the sheet tray 18 is loaded with the sheets S in an amount equal to or larger than the predetermined load amount, the extension end 51A of the light-blocking piece 51 is rotated until reaching the stopper portion 24. When the extension end 51A of the light-blocking piece 51 makes contact with the stopper portion 24, the contact portion 53 receives a new force in the second rotation direction (arrow Y22) from the first arm 61A. The rotation of the first member 61 and the second member 62 is stopped by the new force (hereinafter, referred to as stopping force). A position of the torsion coil spring 35 on the second spring arm 35B side is fixed after receiving transmission of the stopping force, and the first spring arm 35A side of the torsion coil spring 35 is rotated associated with the rotation of the sheet tray 18. As a result, the angle between the first spring arm 35A and the second spring arm 35B spreads from the predetermined angle to cause restoring force to be accumulated in the torsion coil spring 35. In addition, since the contact portion 53 separates away from the protruding portion 43 when the extension end 51A reaches the stop position, it becomes possible to rotate only the rotation shaft 42 in the first rotation direction (arrow Y21) while keeping the extension end 51A stopped at the stop position, and change the angle formed between the contactors 41 and the first arm 61A. In this manner, the connecting mechanism 33 integrally connects the rotation shaft 42 and the cylindrical portion 52 in the first rotation direction (arrow Y21) and the second rotation direction (arrow Y22) until the extension end 51A of the light-blocking piece 51 reaches the stop position. In addition, when the extension end 51A of the light-blocking piece 51 reaches the stop position, the connecting mechanism 33 connects the rotation shaft 42 and the cylindrical portion 52 so as to rotate only the rotation shaft 42 in the first rotation direction (arrow Y21) while keeping the extension end 51A stopped at the stop position.

As shown in FIG. 8D, the extension end 51A of the light-blocking piece 51 makes contact with the stopper portion 24 and is prevented from rotating further in the first rotation direction (arrow Y21). As a result, the first member 61 and the second member 62 are prevented from rotating further. On the other hand, associated with the rotation of the sheet tray 18, the contactors 41 are rotated in the first rotation direction (arrow Y21) to the acceptable limit position of the sheet tray 18. If the load amount of the sheets S loaded on the sheet tray 18 is equal to or larger than the predetermined load amount, the contactors 41 are rotated in the first rotation direction (arrow Y21) to the acceptable limit position. In this case, the connecting mechanism 33 rotates only the rotation shaft 42 in the first rotation direction (arrow Y21) to change the angle formed between the contactors 41 and the first arm 61A. Thus, even when the sheets S are loaded on the sheet tray 18 in an amount equal to or larger than the predetermined load amount, unanticipated force is not applied on the contactors 41, the connecting mechanism 33, the first member 61, and the second member 62, etc., included in the actuator 30A.

When the sheet tray 18 is rotated to the closed position, the contactors 41 are not subjected to any external force through the sheet tray 18. The contactors 41 are rotated in the second rotation direction (arrow Y22) by the restoring force of the torsion coil spring 35 and the weight of the contactors 41. When the contact portion 53 makes contact with the protruding portion 43 associated with the rotation of the contactors 41 in the second rotation direction (arrow Y22), the restoring force of the torsion coil spring 35 and the weight of the contactors 41 are transmitted to the light-blocking piece 51. With this, the contact between the stopper portion 24 and the extension end 51A of the light-blocking piece 51 is released. The first member 61 and the second member 62 become free of the stopping force configured to stop rotation. The connecting mechanism 33 enters a state of being subjected only to the second force in the second rotation direction (arrow Y22) generated by the weight of the contactors 41 from the protruding portion 43 on the contact portion 53, the first force in the first rotation direction (arrow Y21) generated by the weight of the light-blocking piece 51 from the contact portion 53 on the protruding portion 43, and a force by the torsion coil spring 35 for maintaining the predetermined angle. The second force generated by the weight of the contactors 41 is larger than the first force generated by the weight of the first arm 61A, etc. Thus, the protruding portion 43 and the contact portion 53 are integrally rotatable while maintaining the predetermined angle. The contactors 41, and the first member and the second member become connected and rotate in the same rotation direction. Thus, the extension end 51A of the light-blocking piece 51 is moved downward in the up-down direction 8 from the stop position where the stopper portion 24 is disposed.

When the sheet tray 18 is set again in the closed position; the contactors 41, the first member 61, and the second member 62 forming the actuator 30A become connected and operate to enable detection of whether or not the sheets S are loaded on the sheet tray 18 up to the fully loaded state.

[Advantageous Effects of Second Embodiment]

As described above, similar to the actuator 30 of the first embodiment, even when the actuator 30A of the second embodiment of the present disclosure is rotated beyond the acceptable range, damage thereto can be prevented. Furthermore, by providing the transmission mechanism 60 to the actuator 30A of the second embodiment, limitation of the arrangement position of the detection portion 31 is reduced since the contactor 41 and the light-blocking piece 51 can be disposed apart from each other.

[First Modification of First Embodiment]

Figure 9:
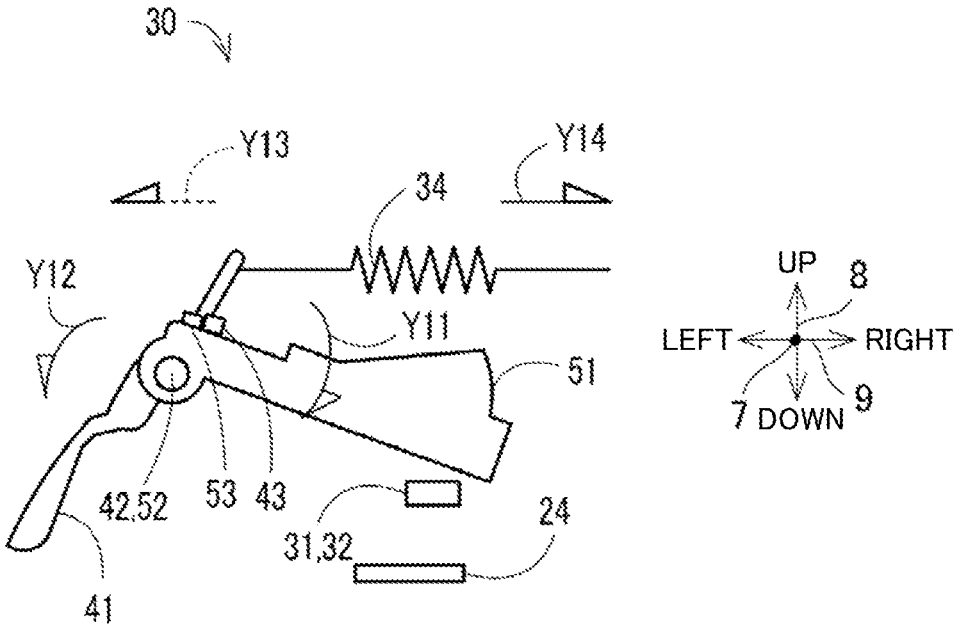
FIG. 9 shows a configuration of an actuator, of a first modification of the first embodiment, on which a spring is formed.

In the description of the first embodiment described above, although a configuration has been described enabling the connecting mechanism 33 to maintain the predetermined angle or change the angle formed between the contactor 41 and the light-blocking piece 51 by a balance of forces generated by the weight of the first rotor 40 and the weight of the second rotor 50; the present disclosure is not limited thereto. For example, as shown in FIG. 9, the connecting mechanism 33 may adjust the balance using an urging force of a spring 34, in addition to its weight. Specifically, a force in the second rotation direction (arrow Y13) obtained by combining the first force in the first rotation direction (arrow Y11) generated by the second rotor 50 and the second force in the second rotation direction (arrow Y12) generated by the first rotor 40 is defined as a third force. In this case, the connecting mechanism 33 is formed to include the spring 34 that generates a fourth force in the first rotation direction (arrow Y14), which is smaller than the third force in the second rotation direction (arrow Y13). By using the spring 34 which is an urging member, the contactor 41 is rotated only by its weight, and an impact force when making contact with the sheet S can be reduced. The arrangement position of the spring 34 does not have to be on the same axis of the rotation shaft 42 and the cylindrical portion 52 as in the case with the torsion coil spring 35 of the second embodiment described above. As shown in FIG. 9, any shape and install position may be used for the spring 34 as long as the first rotor 40 is urged in the first rotation direction. In addition, it becomes possible to adjust the balance of the forces of the first rotor 40 and the second rotor 50 using the urging force of the spring 34. It should be noted that, instead of the spring 34, any material such as rubber may be used as long as the material is an urging member.

[Second Modification of First Embodiment]

Figure 10A:
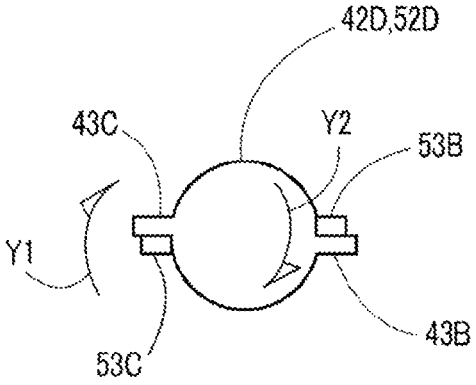
FIGS. 10A and 10B show a configuration of a connecting mechanism of an actuator of a second modification of the first embodiment.
Figure 10B:
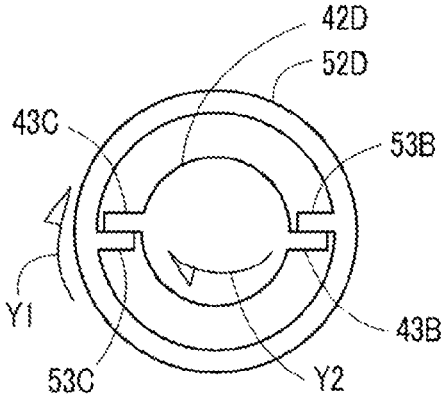

In the description of the first embodiment described above, although a case has been described in which the connecting mechanism 33 includes the single protruding portion 43 and the single contact portion 53; the present disclosure is not limited thereto. For example, as shown in FIG. 10A, a contact may be made between a protruding portion 43B and a contact portion 53B, and a contact may be made between a protruding portion 43C and a contact portion 53C. By setting the number of places of contact to be equal to or more than two, it becomes possible to disperse the force applied to the protruding portion 43 and the contact portion 53 and prevent damage. In addition, as shown in FIG. 10B, the connecting mechanism 33 of the actuator 30 may have a rotation shaft 42D of the first rotor 40 positioned at the center, and have a base end portion 52D of the second rotor 50 connected so as to cover the rotation shaft 42D. In this case, the protruding portions 43B and 43C may be formed in the diameter direction of the rotation shaft 42D, and the contact portions 53B and 53C may be formed toward the center direction from an internal diameter of the base end portion 52D. It is needless to say that the base end portion 52D may be inserted through the rotation shaft 42D. It should be noted that the present second modification is not limited as a modification of the first embodiment described above, but may be applied as a modification of the second embodiment described above.

[Third Modification of First Embodiment]

Figure 11B:
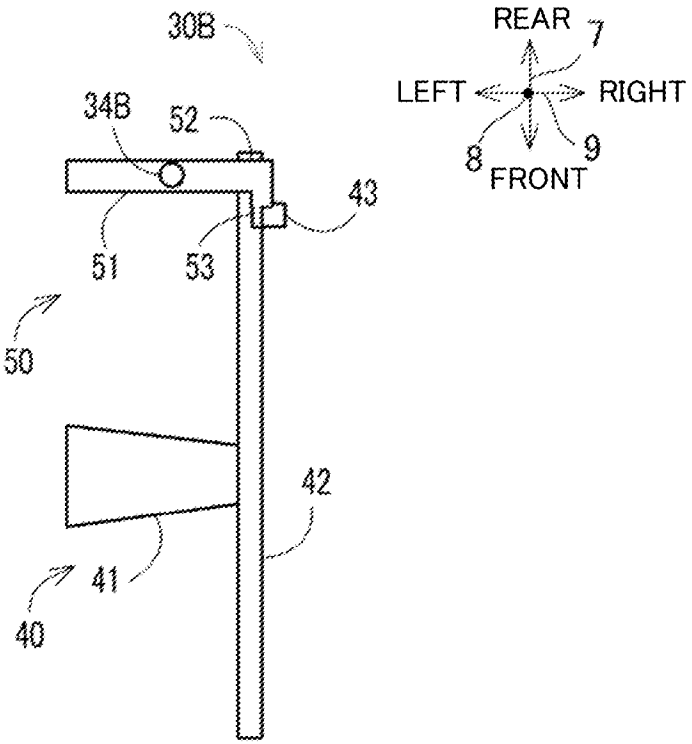
FIGS. 11A and 11B show a configuration of an actuator of a third modification of the first embodiment.
Figure 11A:
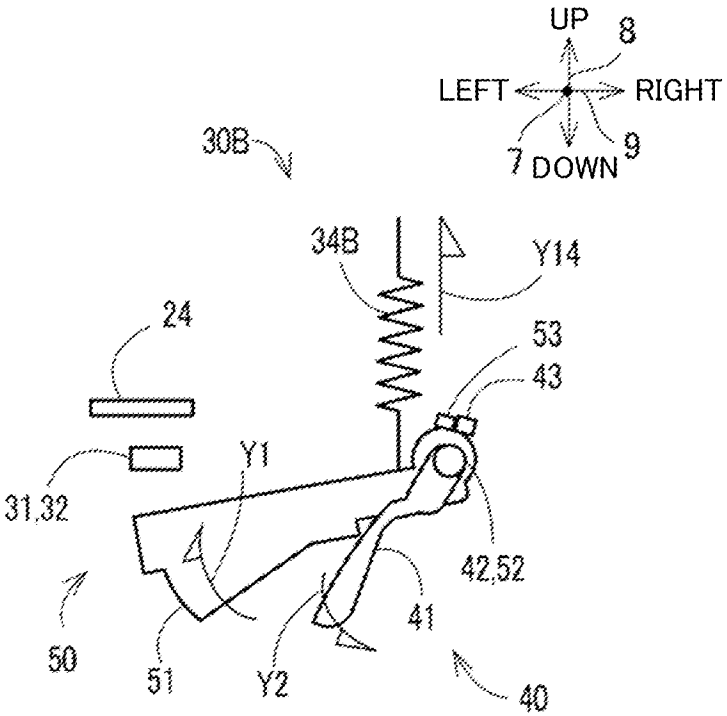

In the description of the first embodiment described above, although a case has been described in which the first rotor 40 is disposed on a side where the sheet S is discharged on the sheet tray 18 from the sheet discharge outlet 27, and the second rotor 50 is disposed on an opposite side of the direction in which the sheet S is discharged; the present disclosure is not limited thereto. For example, as shown in FIGS. 11A and 11B, in an actuator 30B, the first rotor 40 and the second rotor 50 may be both disposed on the side where the sheet S is discharged, and rotatably supported by the rotation shaft 42. In this case, a spring 34B for pulling the light-blocking piece 51 upward (arrow 14) in the up-down direction 8 is provided. Urging force of the spring 34B in the first rotation direction (arrow Y1) is larger than the force of rotation in the second rotation direction (arrow Y2) generated by the weight of the light-blocking piece 51, but is smaller than the force of rotation in the second rotation direction (arrow Y2) generated by the weight of the contactor 41 and the light-blocking piece 51. The protruding portion 43 is disposed on the downstream side of the contact portion 53 in the first rotation direction. Thus, when the sheet tray 18 loaded with the sheet S is rotated in the first rotation direction, the sheet tray 18 makes contact with the first rotor 40 and rotates in the first rotation direction. Since the protruding portion 43 and the contact portion 53 are connected through a contact, the second rotor 50 is also rotated in the same rotation direction. When the light-blocking piece 51 makes contact with the stopper portion 24, the contact between the contact portion 53 and the protruding portion 43 is released. Conversely, when the sheet tray 18 is rotated in the second rotation direction to form a contact between the protruding portion 43 and the contact portion 53, the light-blocking piece 51 rotates in the same direction associated with the rotation of the contactor 41. In this manner, the actuator 30B includes the connecting mechanism 33 capable of maintaining the predetermined angle or changing the angle formed between the contactor 41 and the light-blocking piece 51 with a balance between the force generated by its weight in the second rotation direction and the urging force generated by the spring in the first rotation direction.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a sheet discharge outlet from which a sheet is discharged;

a sheet tray that is rotatable, using its side toward the sheet discharge outlet as a rotation fulcrum, between an open position configured to open an inside of a housing and a closed position configured to close the inside of the housing and enable loading of discharged sheets on the sheet tray;

an actuator configured to rotate in accordance with a load amount of sheets on the sheet tray; and a detection portion configured to detect that a rotation position of the actuator has reached a detection position, wherein the actuator includes:

a first rotation shaft disposed above the sheet discharge outlet;

a base end portion that is connected to the first rotation shaft and is rotatable about the first rotation shaft;

a connection portion configured to connect the first rotation shaft and the base end portion in an integrally rotatable manner in a predetermined rotation direction;

a contactor that extends from the first rotation shaft toward the sheet tray, that is integrally rotatable with the first rotation shaft, and that rotates in accordance with the load amount of sheets loaded on the sheet tray; and a detected member that extends in a direction perpendicular to the first rotation shaft, that is rotatable in response to rotation of the base end portion, that is detected at the detection position by the detection portion, and that is rotatable to a stop position beyond the detection position, and the connection portion is configured to form a connection between, and integrally rotate, in the predetermined rotation direction, the first rotation shaft and the base end portion until the detected member reaches the stop position, and release the connection formed by the connection portion when the detected member reaches the stop position, and rotate, in the predetermined rotation direction, only the first rotation shaft in a state where the detected member is being stopped at the stop position.

2. The image forming apparatus according to claim 1, wherein the connection portion is configured to integrally rotate, in the predetermined rotation direction, the first rotation shaft and the base end portion while maintaining a predetermined angle between the contactor and the detected member, and, when the detected member reaches the stop position, rotate only the first rotation shaft in the predetermined rotation direction to change an angle formed between the contactor and the detected member.

3. The image forming apparatus according to claim 1, wherein the connection portion includes: a protruding portion that is disposed on an outer circumferential surface of the first rotation shaft and protrudes from the outer circumferential surface; and a contact portion that is disposed on an outer circumferential surface of the base end portion and that makes contact with the protruding portion when the first rotation shaft rotates, and when the contact portion makes contact with the protruding portion by rotation of the detected member rotating about the first rotation shaft in the predetermined rotation direction, the contactor and the detected member integrally rotate while maintaining the predetermined angle, until the detected member reaches the stop position.

4. The image forming apparatus according to claim 3, wherein in a state where a first force, generated by a weight of the detected member in a first rotation direction of causing the detected member to move from the detection position toward the stop position, is applied on the protruding portion from the contact portion, the contactor maintains a stationary state in which a rotation thereof is stopped.

5. The image forming apparatus according to claim 3, wherein the sheet tray extends in a discharge direction in which a sheet is discharged from the sheet discharge outlet in the closed position, the detection position is arranged to be on an upstream side of the base end portion in the discharge direction, the detected member is disposed at a position on the upstream side from the base end portion in the discharge direction at an area separated from a sheet discharge path leading to the sheet discharge outlet, outwards in a shaft direction of the first rotation shaft, and is rotatable within a range containing the detection position, and the connection portion is configured to enable integral rotation of the detected member and the first rotation shaft by forming an engagement between the contact portion and the protruding portion until the detected member rotates, in response to rotation of the contactor, in a first rotation direction from the detection position to the stop position, and reaches the stop position, and enable rotation of only the first rotation shaft in the first rotation direction when the engagement between the contact portion and the protruding portion is released when the detected member reaches the stop position.

6. The image forming apparatus according to claim 3, further comprising a stopper member configured to stop rotation of the detected member, in a first rotation direction from the detection position to the stop position, at the stop position when making contact with the detected member.

7. The image forming apparatus according to claim 3, further comprising an urging member configured to apply, on the contactor, a force of urging in a first rotation direction, the force being larger than a force in a second rotation direction opposite to the first rotation direction in which the contactor moves from the detection position to the stop position by its own weight.

8. The image forming apparatus according to claim 1, further comprising a transmission portion disposed between the first rotation shaft and the detected member and configured to transmit rotation force of the first rotation shaft to the detected member and interlock the detected member with the first rotation shaft, wherein the transmission portion includes:

a first arm that extends from the base end portion in a direction perpendicular to the first rotation shaft, and that has a curved portion whose outer side surface in a first rotation direction from the detection position to the stop position is curved in a concaved shape;

a second rotation shaft disposed below the base end portion;

a second arm whose one end is formed rotatable about the second rotation shaft and whose other end extends in a direction from the second rotation shaft to the curved portion and makes contact with the curved portion; and an elastic support portion disposed between the first rotation shaft and the base end portion, and configured to elastically support the first rotation shaft and the base end portion so as to maintain a predetermined angle therebetween, such that the first rotation shaft and the base end portion are integrally rotatable until the detected member reaches the stop position, the detected member extends out from the second rotation shaft in a direction different from that of the second arm, and is configured to be detected by the detection portion at the detection position, and the transmission portion is configured to, when the connection portion enables integral rotation of the first rotation shaft and the base end portion, rotate the first arm associated with rotation of the first rotation shaft, and, associated with the rotation, the curved portion moves an extension end of the second arm in the first rotation direction and rotates the second arm about the second rotation shaft to move an extension end of the detected member toward the stop position.

* * * * *